US008162252B2

(12) United States Patent
Cittadino et al.

(10) Patent No.: US 8,162,252 B2
(45) Date of Patent: Apr. 24, 2012

(54) AUTOMATED TISSUE DISPENSER

(75) Inventors: Antonio M. Cittadino, Appleton, WI (US); Matthew T. Wilcox, De Pere, WI (US); Michael R. Kilgore, Little Suamico, WI (US); Karl D. Kissinger, Appleton, WI (US); Todd D. Schuelke, Fremont, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 519 days.

(21) Appl. No.: 11/866,506

(22) Filed: Oct. 3, 2007

(65) Prior Publication Data

US 2008/0128448 A1 Jun. 5, 2008

Related U.S. Application Data

(60) Provisional application No. 60/848,957, filed on Oct. 3, 2006, provisional application No. 60/848,916, filed on Oct. 3, 2006.

(51) Int. Cl.
*B65H 19/00* (2006.01)

(52) U.S. Cl. ..... 242/560; 254/564.3

(58) Field of Classification Search ..... 242/560, 242/563, 563.2, 564, 564.1, 564.3, 564.4, 242/565; 312/34.8, 34.22
See application file for complete search history.

(56) References Cited

U.S. PATENT DOCUMENTS

| | | | | |
|---|---|---|---|---|
| 2,121,346 | A | | 6/1938 | Harvey |
| 2,943,777 | A | * | 7/1960 | Dvoracek ..... 225/38 |
| 2,993,658 | A | | 7/1961 | Sweeney |
| 4,165,138 | A | | 8/1979 | Hedge et al. |
| 4,552,315 | A | | 11/1985 | Granger |
| 4,765,555 | A | | 8/1988 | Gambino |
| 4,844,361 | A | | 7/1989 | Granger |
| 4,846,412 | A | | 7/1989 | Morand |
| 4,944,466 | A | | 7/1990 | Jespersen |
| D342,635 | S | | 12/1993 | Carter et al. |
| 5,558,302 | A | | 9/1996 | Jesperson |

(Continued)

FOREIGN PATENT DOCUMENTS

EP 1230886 A1 8/2002

(Continued)

OTHER PUBLICATIONS

International Preliminary Report on Patentability of PCT/US2007/080308, dated Apr. 16, 2009.

(Continued)

*Primary Examiner* — William A Rivera
(74) *Attorney, Agent, or Firm* — Georgia-Pacific LLC; Deborah K. Butler

(57) ABSTRACT

An automated dispenser includes a rotatable carousel including a mounting station for a primary roll of sheet product and a mounting station for a reserve roll of sheet product; mounting brackets configured for mounting the carousel such that it is movable between a locked, rearward position for dispensing and a forward position where the carousel is rotatable for reloading; a drive system including a motor coupled to a drive roller and control circuitry; a transfer mechanism adapted so as to be operable to urge a tail of the reserve roll toward a dispensing nip of the drive system upon depletion of the primary roll; a housing; and an auxiliary access aperture fitted with an access door, the auxiliary aperture and access door being configured and adapted to be manually operable to expose the reserve roll for manual dispensing.

11 Claims, 24 Drawing Sheets

U.S. PATENT DOCUMENTS

| | | | |
|---|---|---|---|
| 5,604,992 | A | 2/1997 | Robinson |
| 5,628,474 | A | 5/1997 | Krueger et al. |
| D386,025 | S | 11/1997 | Mervar et al. |
| 5,772,291 | A | 6/1998 | Byrd et al. |
| 5,979,821 | A | 11/1999 | LaCount et al. |
| 5,979,822 | A | 11/1999 | Morand et al. |
| 6,032,898 | A | 3/2000 | LaCount et al. |
| 6,069,354 | A | 5/2000 | Alfano et al. |
| 6,105,898 | A | 8/2000 | Byrd et al. |
| 6,109,473 | A | 8/2000 | Neveu et al. |
| 6,138,939 | A | 10/2000 | Phelps et al. |
| 6,152,397 | A | 11/2000 | Purcell |
| D441,231 | S | 5/2001 | Purcell et al. |
| 6,237,871 | B1 | 5/2001 | Morand et al. |
| 6,250,530 | B1 | 6/2001 | LaCount et al. |
| 6,293,486 | B1 | 9/2001 | Byrd et al. |
| 6,328,252 | B1 | 12/2001 | Neveu et al. |
| 6,354,533 | B1 | 3/2002 | Jespersen |
| 6,474,591 | B1 | 11/2002 | Granger |
| 6,592,067 | B2 | 7/2003 | Denen et al. |
| 6,607,160 | B2 | 8/2003 | Lewis et al. |
| 6,616,088 | B2 | 9/2003 | Lintelmann et al. |
| 6,685,074 | B2 | 2/2004 | Gracyalny et al. |
| 6,695,246 | B1 | 2/2004 | Elliott et al. |
| 6,710,606 | B2 | 3/2004 | Morris |
| 6,736,348 | B1 | 5/2004 | Formon et al. |
| 6,742,689 | B2 | 6/2004 | Formon et al. |
| 6,752,349 | B2 | 6/2004 | Moody et al. |
| 6,793,170 | B2 | 9/2004 | Denen et al. |
| 6,826,985 | B2 | 12/2004 | Broehl |
| 6,830,210 | B2 | 12/2004 | Formon et al. |
| 6,854,684 | B2 | 2/2005 | Byrd et al. |
| 6,871,815 | B2 | 3/2005 | Moody et al. |
| 6,895,848 | B1 | 5/2005 | Svensson |
| 6,903,654 | B2 | 6/2005 | Hansen et al. |
| 6,977,588 | B2 | 12/2005 | Schotz et al. |
| 6,994,408 | B1 | 2/2006 | Bunnell |
| 7,017,856 | B2 | 3/2006 | Moody et al. |
| 7,040,566 | B1 | 5/2006 | Rodrian et al. |
| 7,044,421 | B1 | 5/2006 | Omdoll et al. |
| D525,063 | S | 7/2006 | Woods et al. |
| 7,101,441 | B2 | 9/2006 | Kennard |
| D547,581 | S | 7/2007 | Cittadino et al. |
| D551,474 | S | 9/2007 | Cittadino et al. |
| D551,475 | S | 9/2007 | Cittadino et al. |
| 7,296,765 | B2 | 11/2007 | Rodrian |
| 7,370,824 | B1 | 5/2008 | Osborne |
| D572,058 | S * | 7/2008 | Cittadino et al. ..... D6/518 |
| 7,398,944 | B2 * | 7/2008 | Lewis et al. ..... 242/563 |
| 7,438,257 | B2 | 10/2008 | Kennard |
| 2002/0109035 | A1 | 8/2002 | Denen et al. |
| 2003/0167893 | A1 | 9/2003 | Morris et al. |
| 2003/0168489 | A1 | 9/2003 | Formon et al. |
| 2003/0168550 | A1 | 9/2003 | Formon et al. |
| 2003/0197086 | A1 | 10/2003 | Denen et al. |
| 2004/0035976 | A1 | 2/2004 | Byrd et al. |
| 2004/0041057 | A1 | 3/2004 | Byrd et al. |
| 2004/0135027 | A1 | 7/2004 | Elliott et al. |
| 2004/0178297 | A1 | 9/2004 | Moody et al. |
| 2005/0077419 | A1 | 4/2005 | Thomas et al. |
| 2005/0150992 | A1 | 7/2005 | Morris et al. |
| 2006/0054733 | A1 | 3/2006 | Moody et al. |
| 2006/0169827 | A1 * | 8/2006 | Lewis et al. ..... 242/563 |
| 2006/0175341 | A1 | 8/2006 | Rodrian |
| 2006/0202080 | A1 | 9/2006 | Kennard |
| 2006/0237579 | A1 * | 10/2006 | Doubleday et al. ..... 242/595 |
| 2007/0080255 | A1 * | 4/2007 | Witt et al. ..... 242/563.2 |
| 2007/0176041 | A1 | 8/2007 | Friesen et al. |
| 2008/0018302 | A1 * | 1/2008 | Reinsel et al. ..... 242/564.1 |

FOREIGN PATENT DOCUMENTS

| | | | |
|---|---|---|---|
| FR | 2761252 | A1 | 10/1998 |
| GB | 2063213 | A | 6/1981 |
| JP | 4-265699 | A | 9/1992 |

OTHER PUBLICATIONS

U.S. Appl. No. 12/093,356, filed May 12, 2008, (which is the national phase of International Application No. PCT/FR2006/002473 filed Nov. 7, 2006).

International Search Report for PCT/FR2006/002473 that issued Apr. 18, 2007.

Written Opinion of the International Search Authority for PCT/FR2006/002473.

International Search Report and Written Opinion of the International Searching Authority that issued Jul. 3, 2008 in connection with PCT/US2007/080308.

Information on Product Code: 09619, Kimberly Clark Professional wbsite, http://www.kcprofessional.com/us/product-details.asp-?prd_id=09619, viewed Dec. 17, 2007.

European Search Report and Opinion Dated Aug. 23, 2011.

* cited by examiner

AUTOMATED TISSUE DISPENSER

CROSS-REFERENCE TO RELATED APPLICATIONS

This application claims the benefit of the filing date of U.S. Provisional Patent Application No. 60/848,957, filed Oct. 3, 2006, and U.S. Provisional Patent Application No. 60/848,916, filed Oct. 3, 2006, which are herein incorporated by reference in their entirety.

BACKGROUND

The present disclosure generally relates to multi-roll dispensers and more particularly to an automated, hands-free multi-roll carousel-style dispenser suitable for dispensing sequentially a primary roll and reserve roll of tissue.

Automated, hands-free paper towel dispensers are known and are a preferred way of dispensing paper towel in a commercial setting, since waste is generally less than with conventional dispensers and the potential for contamination is greatly reduced. Generally, the dispensers are activated by way of a proximity sensor and/or a reset switch.

While plentiful art is directed to powered dispensers suitable for relatively stiff, or higher basis weight materials, existing dispensers do not offer the features and reliability needed for automated dispensing of low basis weight sheet products, where availability of product is of critical importance. Indeed, despite a strong consumer preference for automated dispensers, tissue roll dispensers tend to be rudimentary in construction.

Accordingly, a continual need exists for automated dispensers suitable for dispensing relatively low basis weight materials such as bath tissue.

BRIEF SUMMARY

Disclosed herein are automated dispensers and methods of automatically dispensing a roll of tissue or towel.

In one embodiment, an automated dispenser comprises: (a) a rotatable carousel including a mounting station for a primary roll of sheet product and a mounting station for a reserve roll of sheet product; (b) mounting brackets configured for mounting the carousel such that it is movable between a locked, rearward position for dispensing and a forward position where the carousel is rotatable for reloading; (c) a drive system including a motor coupled to a drive roller and control circuitry; (d) a transfer mechanism adapted so as to be operable to urge a tail of the reserve roll toward a dispensing nip of the drive system upon depletion of the primary roll; (e) a housing for enclosing the rotatable carousel, drive system and transfer mechanism as well as for sequestering the primary and reserve rolls of sheet product, the housing including a front portion, a back portion, and sidewalls, the housing including a bottom portion with a dispensing aperture; and (f) an auxiliary access aperture fitted with an access door, the auxiliary aperture and access door being configured and adapted to be manually operable to expose the reserve roll for manual dispensing.

In one embodiment, an automated dispenser comprises: (a) a mounting station for holding a roll of sheet product; (b) a drive system including a drive roller coupled to a motor and control circuitry responsive to a control signal; (c) an upper pinch roller bearing upon the drive roller defining an upper dispensing nip with the drive roller; and (d) a lower pinch roller bearing upon the drive roller defining a lower dispensing nip with the drive roller; wherein the upper and lower pinch rollers are circumferentially-spaced such that they include therebetween at least 15° of the drive roll circumference profile.

In one embodiment, an automated dispenser comprises: (a) a mounting station for a primary roll of sheet product; (b) a mounting station for a reserve roll of sheet product; (c) a drive system adapted to sequentially dispense the primary roll of sheet product followed by the reserve roll of sheet product, the drive unit including a drive roller and a pinch roller defining a dispensing nip through which sheet product is drawn from the primary roll and the reserve roll; (d) a transfer mechanism comprising (i) a transfer frame pivotally mounted and biased to a reserve dispensing position and movable to a primary dispensing position about its axis of rotation, as well as (ii) a pivotally mounted transfer shield coupled to the biased transfer frame, the transfer shield including a transfer bar being likewise movable between a primary dispensing position and a reserve dispensing position about its axis of rotation; and (e) a releasable transfer lock configured to lock the transfer arm in the primary dispensing position and adapted to respond to depletion of the primary roll to release the transfer arm such that the transfer arm returns to the reserve position; wherein the transfer shield is configured and coupled to the transfer frame such that it pivots to its reserve position concurrently with the transfer frame, the transfer shield being displaced by the transfer frame such that the transfer bar moves toward the dispensing nip and is thereby operable to supply product to the dispensing nip from a tail of the reserve roll.

In one embodiment, an automated dispenser comprises: (a) a mounting station for a primary roll of sheet product; (b) a mounting station for a reserve roll of sheet product; (c) a drive system including a motor coupled to a drive roll and control circuitry as well as a pinch roller defining a dispensing nip with the drive roll adapted to dispense sheet product through the dispensing nip in response to a control signal controlling the motor; and (d) a housing enclosing the first and second mounting stations thereby sequestering the primary and reserve rolls of sheet product, the housing further including an auxiliary access aperture fitted with an auxiliary access door, the aperture and access door being configured and adapted to be manually operable to expose the reserve roll for manual dispensing.

In one embodiment, a method of automatically dispensing a roll of tissue or towel comprises (a) disposing a roll of paper tissue or towel having a bending length of less than 3.5 cm in an automated dispenser including (i) a mounting station for a primary roll of sheet product; (ii) a mounting station for a reserve roll of sheet product; (iii) a motorized drive unit adapted to sequentially dispense the primary roll of sheet product through a dispensing nip followed by the reserve roll of sheet product in response to a control signal controlling a motor; (iv) a housing enclosing the first and second mounting stations thereby sequestering the primary and reserve rolls of sheet product; and (v) the dispenser further includes a downwardly facing dispensing aperture adjacent a dispensing channel which extends from the dispensing nip to the aperture and has a downwardly extending outlet portion; and (b) dispensing the roll of tissue or towel through the dispensing aperture in a downward direction in response to the control signal.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Figure 1:
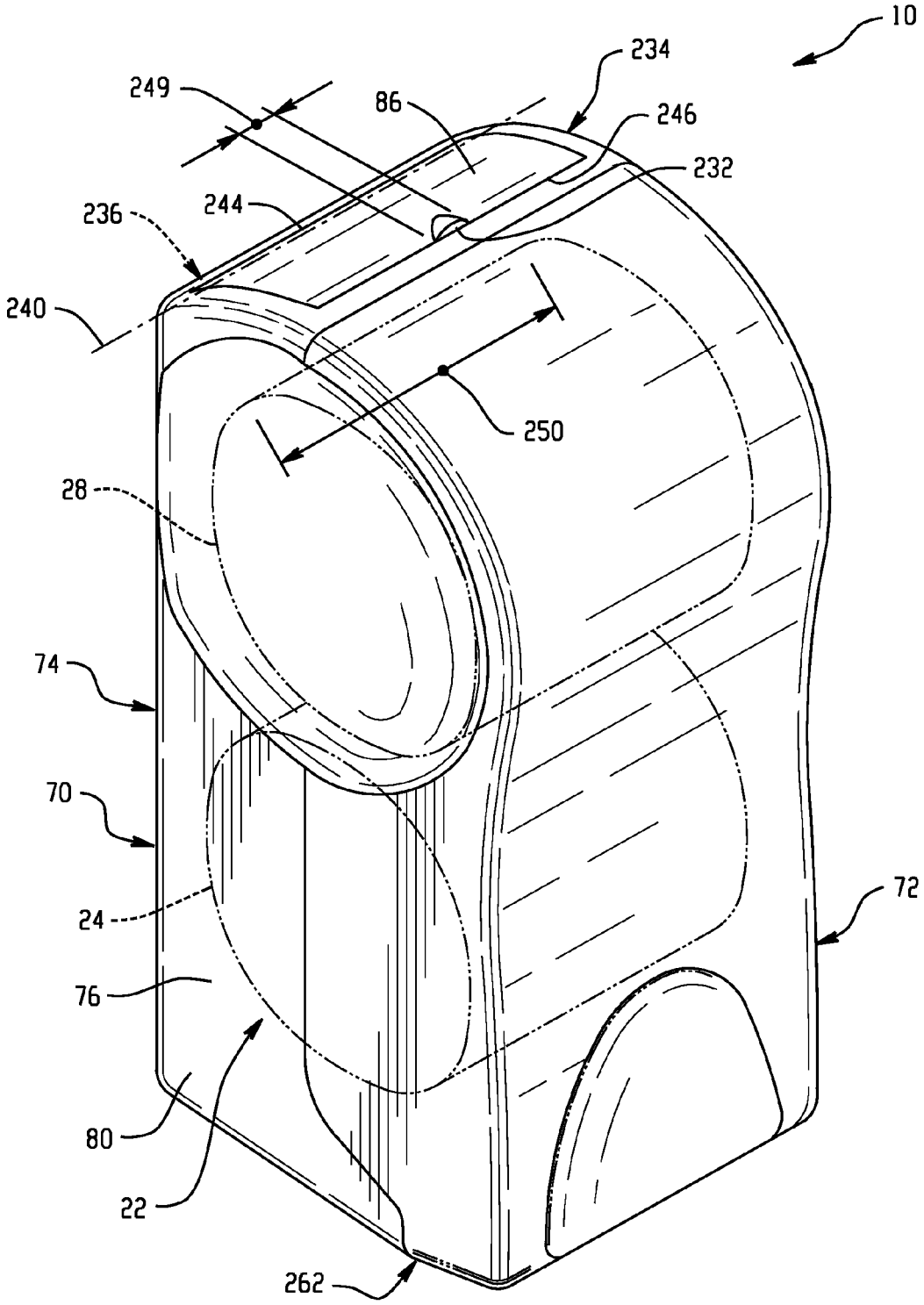
FIG. 1 is a view in perspective and elevation of an embodiment of an automated dispenser.
Figure 2:
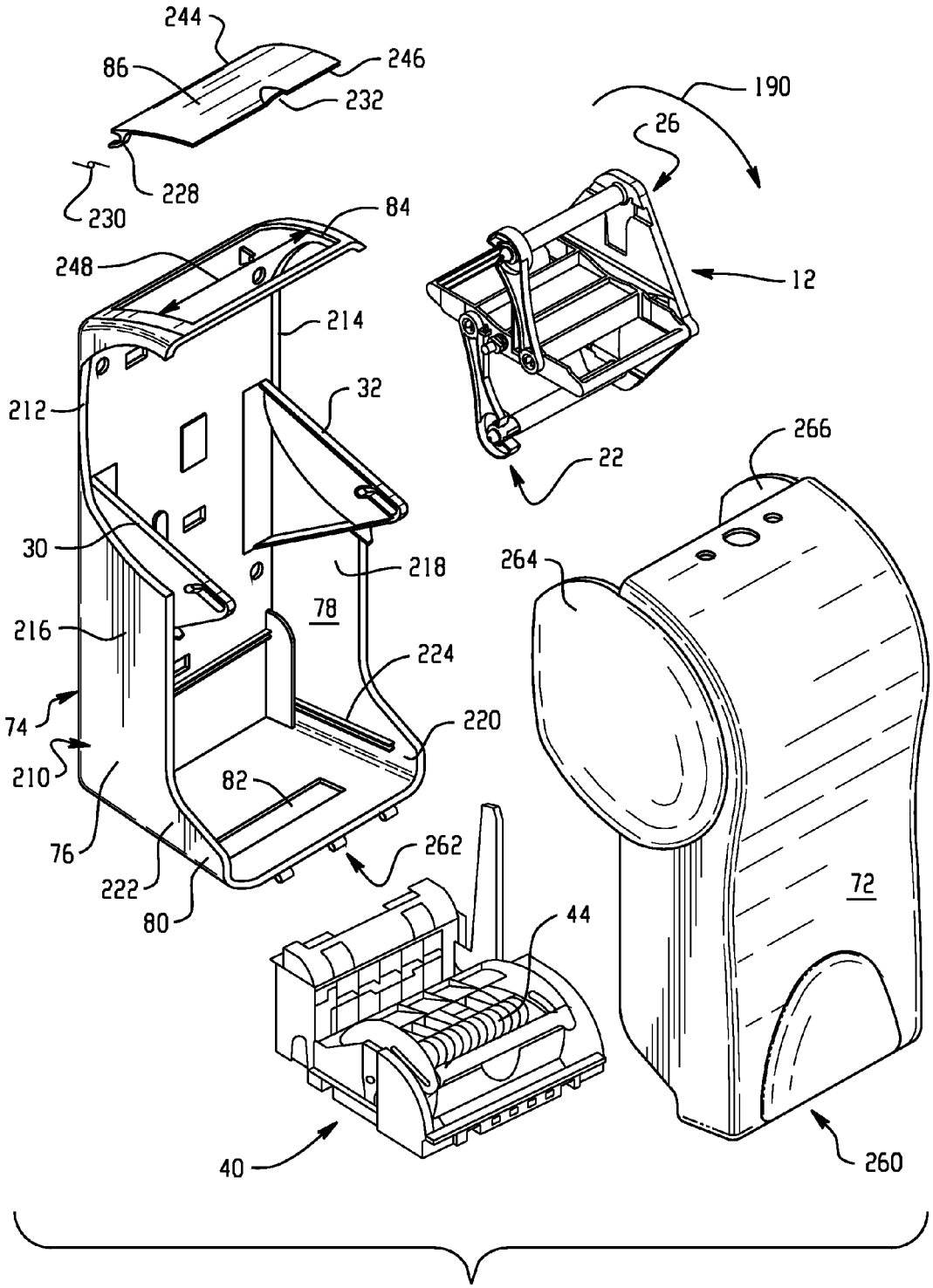
FIG. 2 is an exploded view of the dispenser of FIG. 1.

Disclosed herein are automated dispensers that can be adopted for use with a variety of sheet products. For example, the sheet product dispenser may be employed with one or more rolls. The term "sheet products" is inclusive of natural and/or synthetic cloth or paper sheets. Further, sheet products can include both woven and non-woven articles. Examples of sheet products include, but are not limited to, wipers, napkins, tissues, and towels. For ease in discussion, however, reference is hereinafter made to embodiments particularly suited for dispensing tissue.

Tissue is distinguished from paper towel by numerous characteristics. For one, tissue typically, has a MD (machine direction) bending length of less than about 3.5 cm (centimeters) as measured in accordance with ASTM test method D 1388-96, cantilever option. Further, rolls of tissue typically have a width of less than 5 inches, while rolls of paper towel typically have a width of more than 9 inches. Also, tissue, especially bathroom tissue, is manufactured without the use of permanent wet strength resins and incorporates more softwood fiber than towel. Generally, tissue includes more than 40 percent by weight of hardwood fiber, while paper towel may include much less. Towel also has a higher basis weight (i.e., the weight of a 3000 $ft^2$ (square foot) ream of product), typically more than 20 lbs (pounds) per 3000 square foot ream, while tissue has a basis weight of less than 20 lbs per 3000 square foot ream.

In one embodiment, sheet products for use in connection with the dispensers disclosed herein may have an MD bending length of less than about 4 cm such as less than about 3.5 cm or suitably less than about 3 cm. Sheet products used may also have an MD bending length of less than about 2.75 cm, less than about 2.5 cm, less than about 2.25 cm or perhaps less than about 2 cm in some cases.

When tissue is dispensed it may include at least 50% by weight of hardwood fiber (based on fiber content) or at least 60% or 70% by weight of hardwood fiber based on fiber content. Suitably, tissue may have less than 50% or less than 40% by weight of softwood fiber based on the fiber content of the sheet.

Low basis weight, low modulus tissue or towel is readily dispensed by embodiments of the automated dispenser disclosed herein. The sheet may have a basis weight of less than 25 lbs per 3000 $ft^2$ ream or less than 17.5 lbs per 3000 $ft^2$ ream. The various features of the present invention are better understood by reference to the drawings.

There is shown in FIGS. 1 through 7 an automated dispenser 10 for multiple rolls of sheet product, suitable for dispensing tissue or towel with an MD bending length of less than about 3.5 cm; dispenser 10 including a rotatable carousel 12 including a mounting station 22 for a primary roll 24 of sheet product and a mounting station 26 for a reserve roll 28 of sheet product. Carousel 12 is mounted on mounting brackets 30, 32 configured for mounting the carousel 12 such that it is movable between an inner locked, backward position indicated at 34 (FIG. 13B) for dispensing and an outer forward position indicated at 36 (FIG. 13C) where the carousel is rotatable for reloading.

A modular drive/transfer system 40 includes a motor 42 coupled to a drive roller 44 and control circuitry indicated at 46 as well as a pair of circumferentially-spaced pinch rollers 48, 50 bearing upon drive roller 44 to define a pair of dispensing nips 52, 54, the drive system being adapted to dispense sheet product from either the primary roll of sheet product or the reserve roll of sheet product in response to a control signal. The dispensing nips 52, 54 provide a relatively large amount of "wrap" around the drive roller 44 and are operable to feed product in the event of break in the web, even when the break extends through one of the nips. In one embodiment, a rubber material can be disposed in bands 49 spaced over at least one of the pinch rollers (e.g., pinch roller 48).

Figure 4:
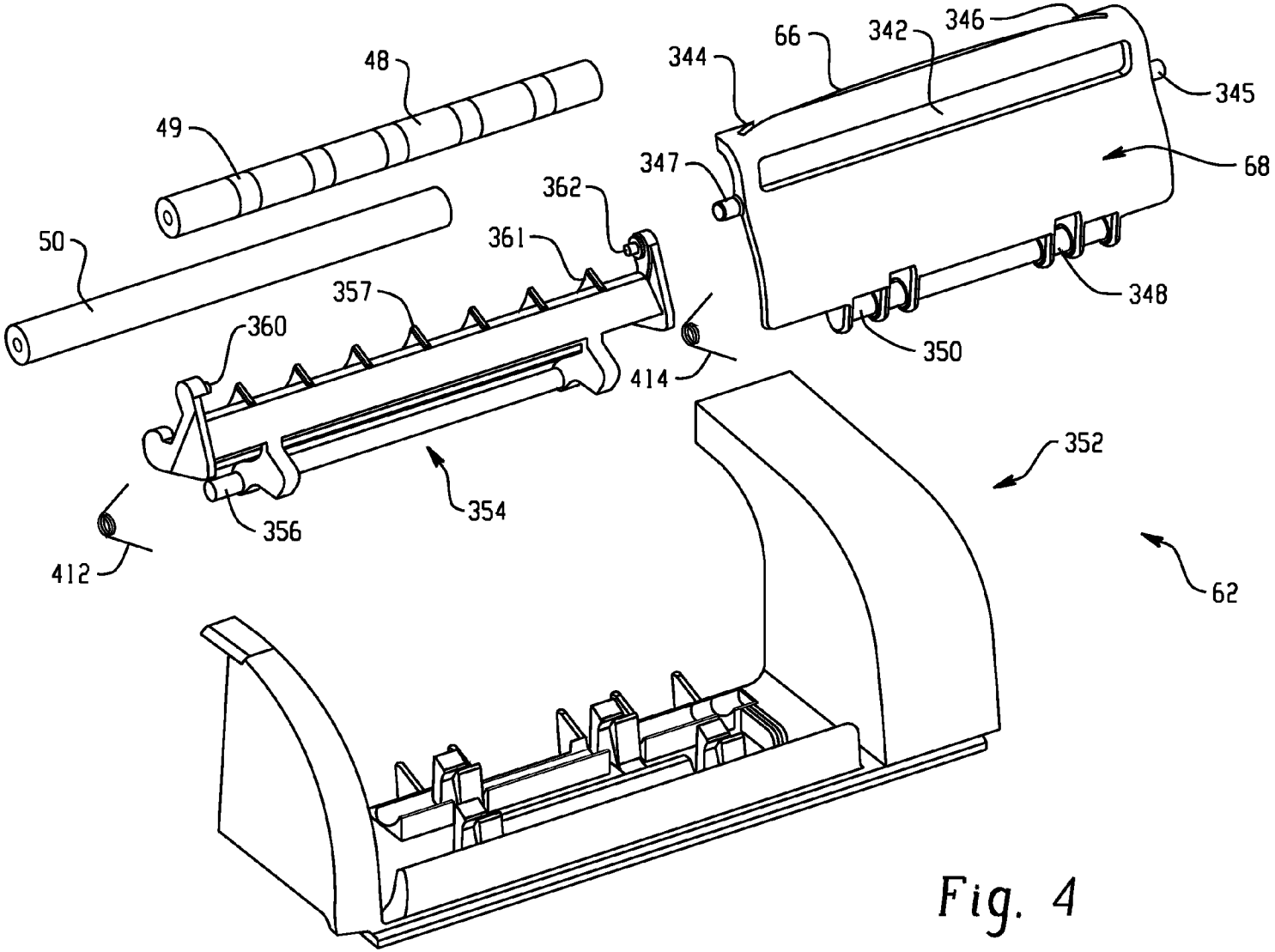
FIG. 4 is an exploded view of a sub-assembly module, which also mounts a pair of pinch rollers.

Transfer system 40 is further provided with a transfer mechanism 60 (see, additionally, FIGS. 20, 21) including transfer frame 64 and transfer shield 68 which is mounted on a sub-assembly 62 (FIG. 4). A transfer bar 66 is provided as part of a transfer shield 68 mounted and adapted so as to be operable to urge a tail of the reserve roll toward a dispensing nip of the drive system upon depletion of the primary roll. A housing 70 encloses the rotatable carousel 12, drive and transfer system 40 as well as the primary and reserve rolls of sheet product. The housing 70 includes a front portion 72, a back portion 74, and sidewalls 76, 78, and a bottom portion 80 with a dispensing aperture 82. The housing 70 also includes an auxiliary access aperture 84 fitted with an auxiliary access door 86 biased to a closed position. The auxiliary aperture and access door are configured and adapted to be manually operable to expose the reserve roll for manual dispensing through aperture 84.

Figure 6:
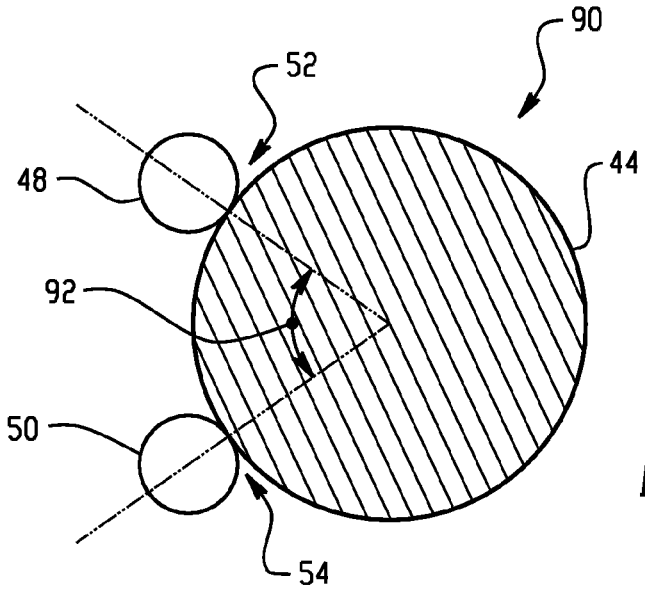
FIG. 6 is a schematic diagram illustrating the spacing of a pair of pinch rollers, which define dispensing nips with the drive roll.

The pinch rollers are circumferentially-spaced such that they include therebetween at least 15° of drive roll circumference profile 90 as is illustrated schematically in FIG. 6. That is, the pinch rollers are spaced so that they define an angle 92 which may be, for example, from 30° to 100°; in some cases at least 45°, in others at least 60° and in still other cases at least 75°.

In one embodiment, the control circuitry includes a proximity sensor such as an infra-red sensor or a capacitance sensor. The location of the sensor can vary depending on the application. In one embodiment, an infra-red sensor (not shown) is disposed proximate the bottom portion 80. More particularly, the infra-red sensor can be positioned such that it is placed in a location before the dispensing aperture 82, such that as a user's hand is proximate to the dispensing aperture dispensing is triggered. In other embodiments, the proximity circuit can be disposed in the front 72 of the dispenser 10. Further, the control circuitry can be programmed for different time delays between dispenses.

Figure 7:
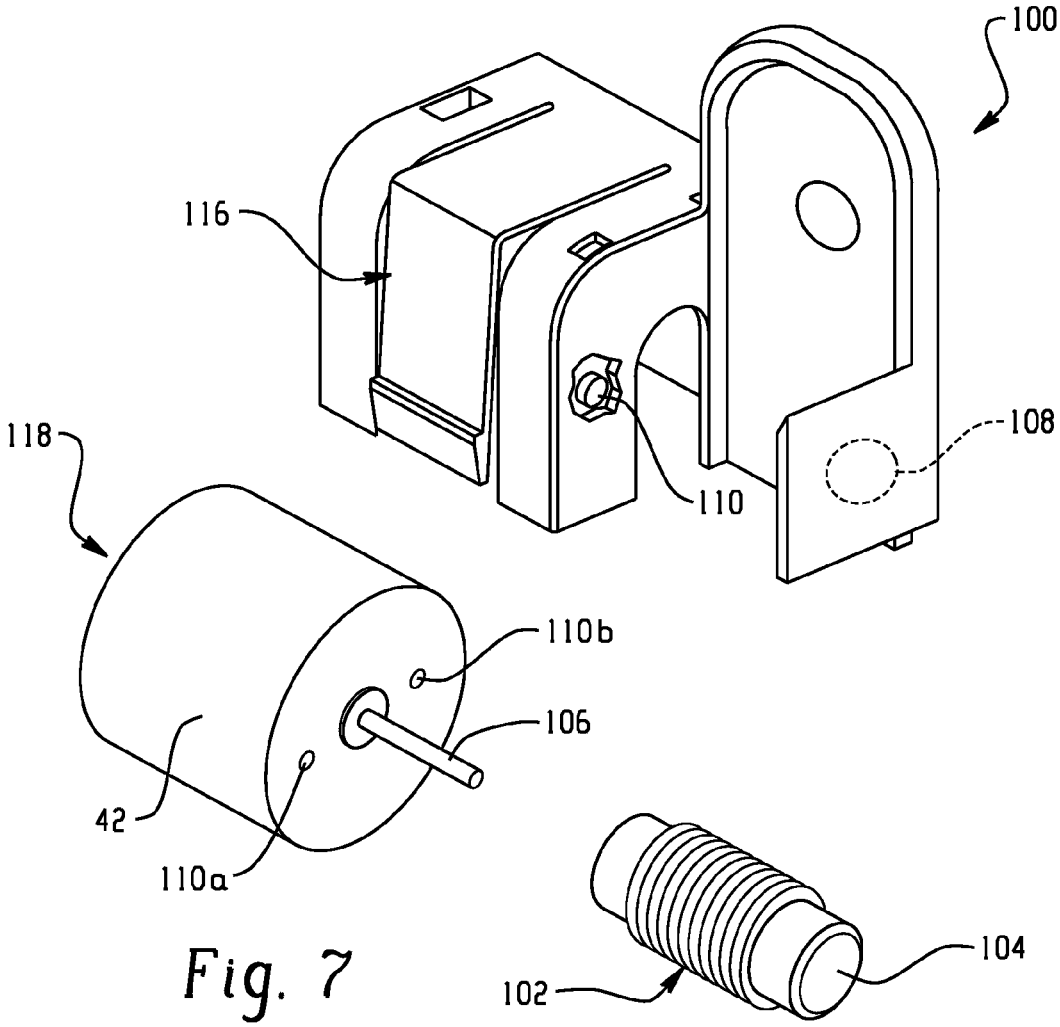
FIG. 7 is an exploded view showing a motor and worm gear drive module.

Referring to FIG. 7, the motor is mounted in a unitary, motor mount 100 and drive unit 40 includes a worm gear member 102 having a mounting cavity 104 on an end thereof fitted to a shaft 106 of the motor such that the mounting cavity of member 102 is outwardly exposed and mounted on a cylindrical boss indicated at 108. Mount 100 includes a plurality of mounting projections such as is indicated at 110 for inserting into holes 110*a*, 112*b* of motor 42. Also provided is a snap fit feature at 116 for supporting the motor at 118. Worm gear member 102 is suitably manufactured by way of injection molding such that it is substantially free of mold parting lines; for example, removed from a mold be "unscrewing" the part rather than using a separable mold.

In one embodiment, drive roller 44 is configured and positioned to dispense sheet product downwardly over an optional movable reset bar 312 connected to a reset switch of the control circuitry of the dispenser. In other embodiments, the dispenser 10 does not include a reset bar and a reset switch. Rather, the control circuit can be programmed to reset after a predetermined amount of time. The reset time can vary depending on user preference. For example, in one embodiment, the reset time is less than or equal to about 2 seconds.

Figure 8:
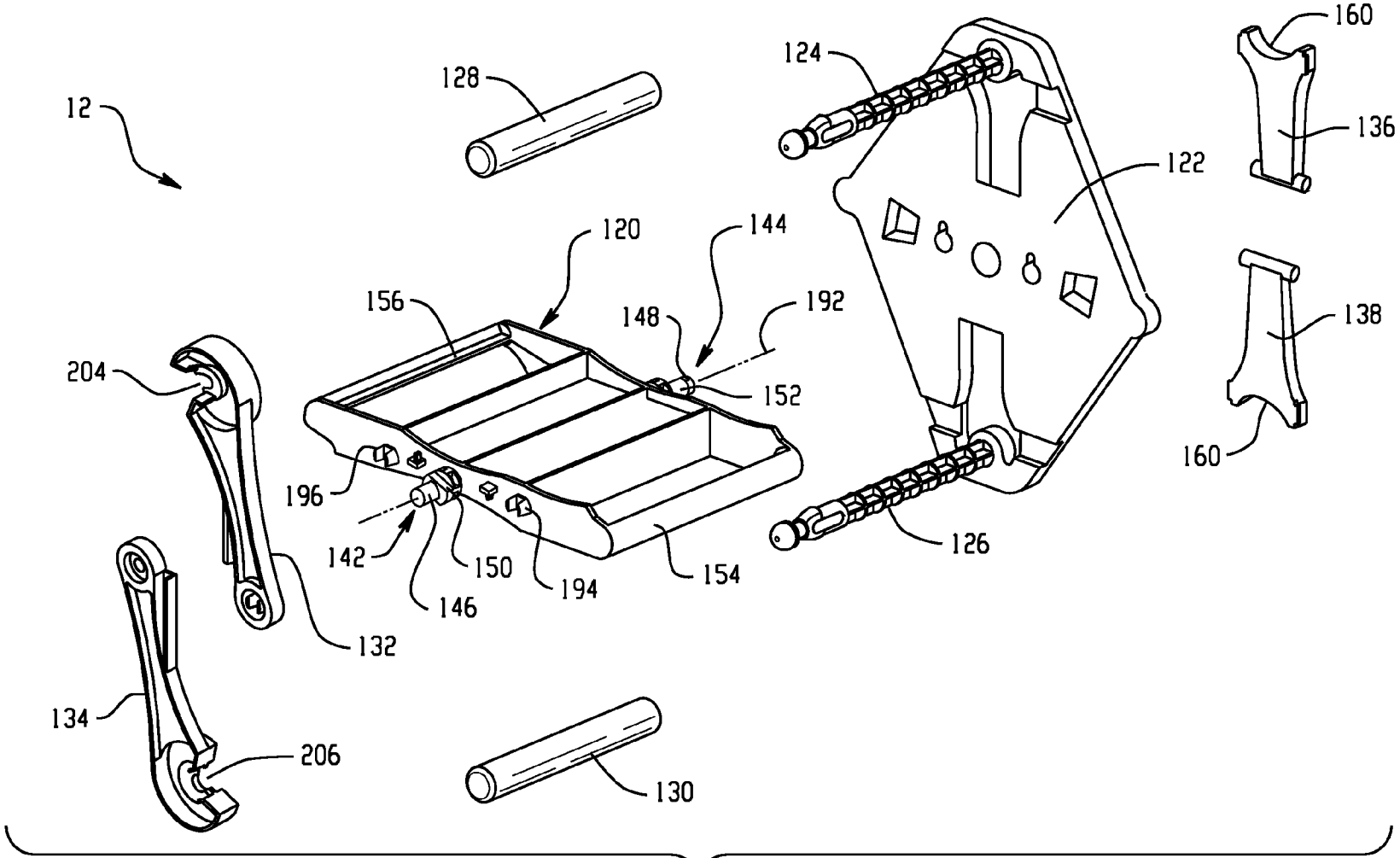
FIG. 8 is an exploded view of the rotatable mounting carousel of the dispenser.

FIG. 8 is an exploded view of carousel 12. Carousel 12 includes a frame 120 as well as a mandrel base 122 upon which are mounted support shafts 124, 126. Also included are support spindles 128, 130 for mounting reserve roll 28 and primary roll 24. Carousel 12 further includes spindle locks 132, 134, release arms 136, 138.

Figure 9:
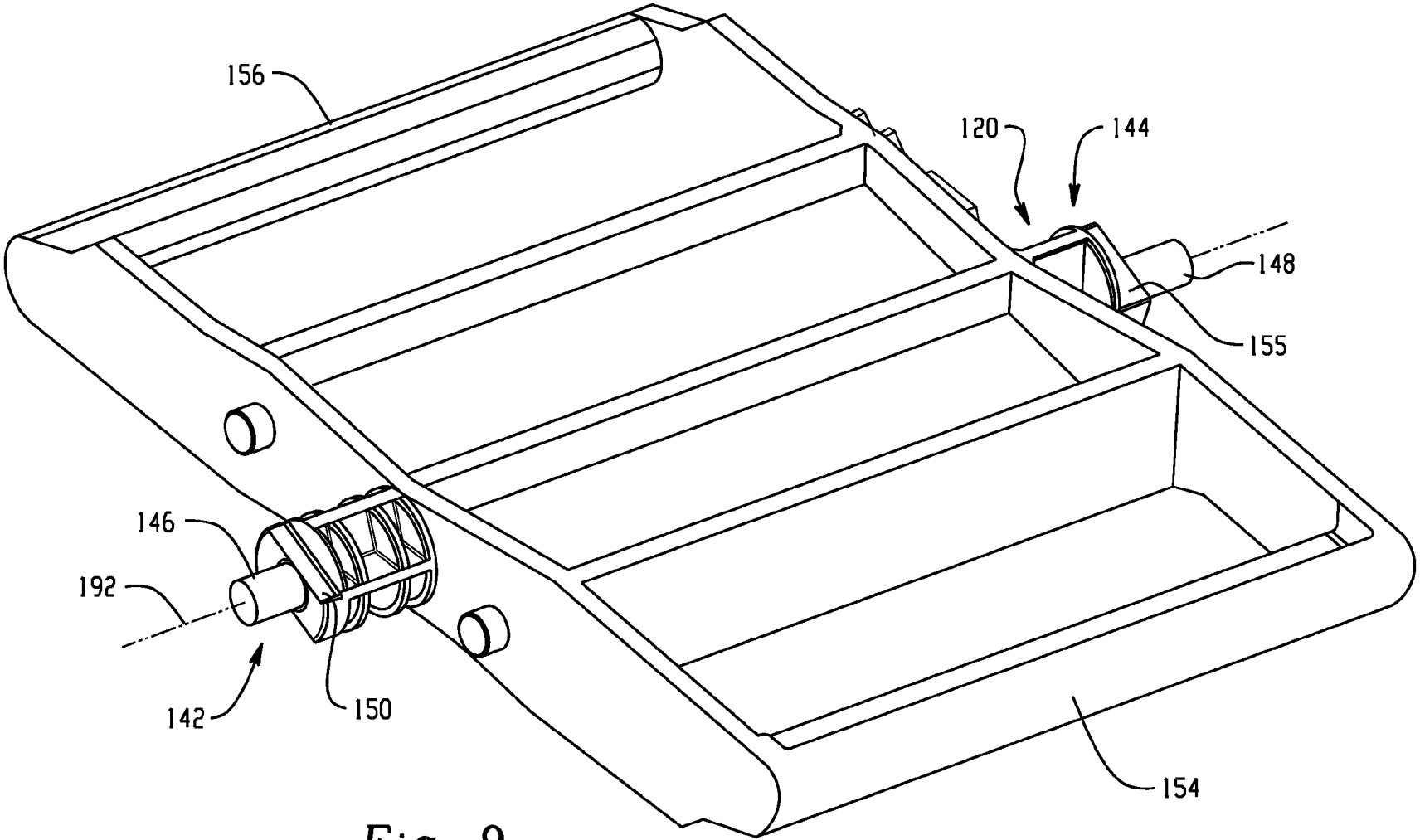
FIG. 9 is a perspective view of the frame of the carousel.

FIG. 9 is an enlarged view of frame 120 whereon support shafts 142, 144 are more clearly seen. Shafts 142, 144 have outer shaft mounting portions 146, 148, as well as locking key lugs 150, 152. Also provided are guide bars 154, 156 at the frontward and rearward portions of the frame.

Figure 10:
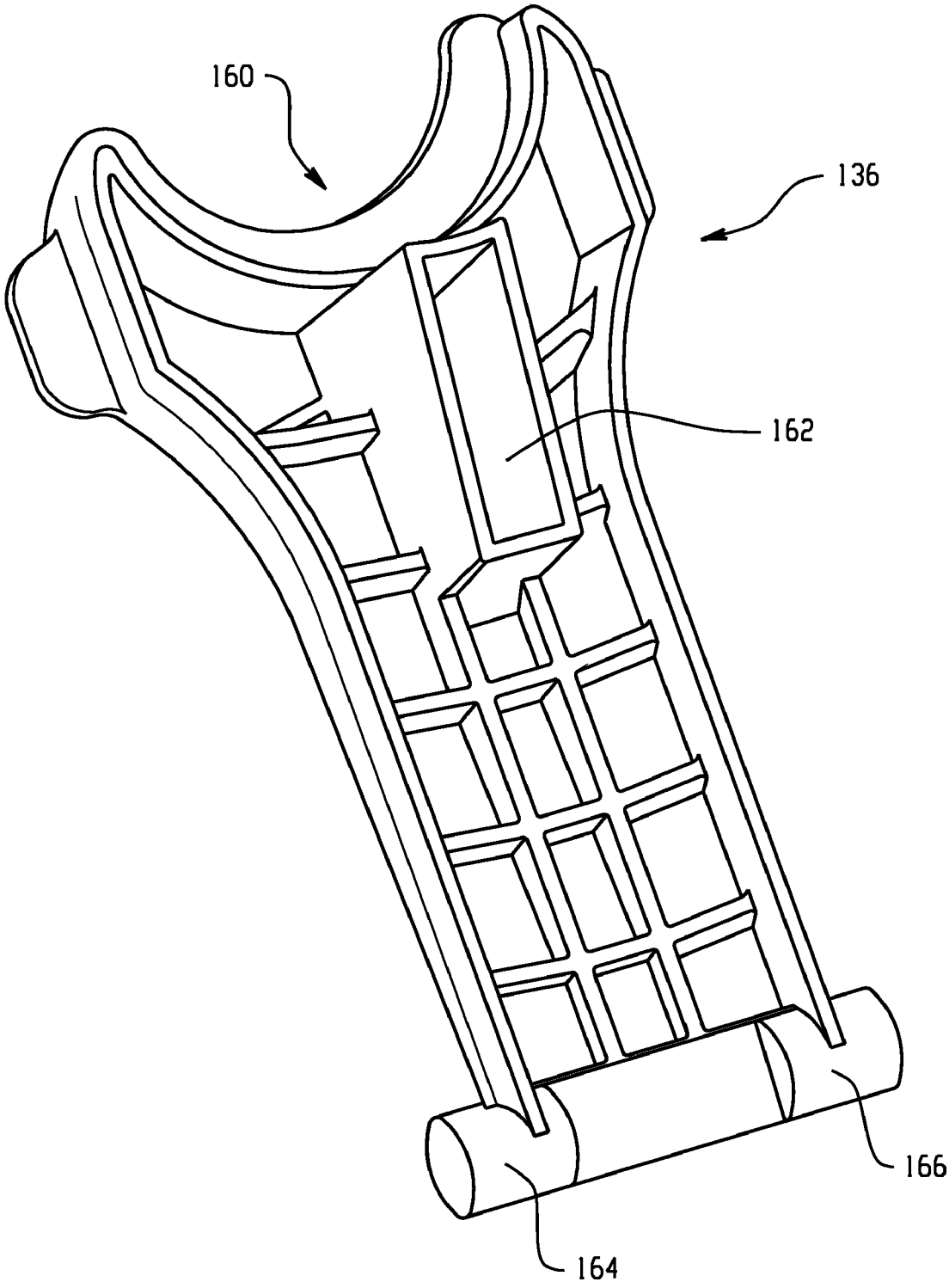
FIG. 10 is a view in perspective of a release arm of the carousel.

FIG. 10 is an enlarged perspective view of release arm 136. Arm 136 has an arcuate sensor portion 160, a latch projection 162 and cylindrical mounting portions 164, 166.

Figure 11A:
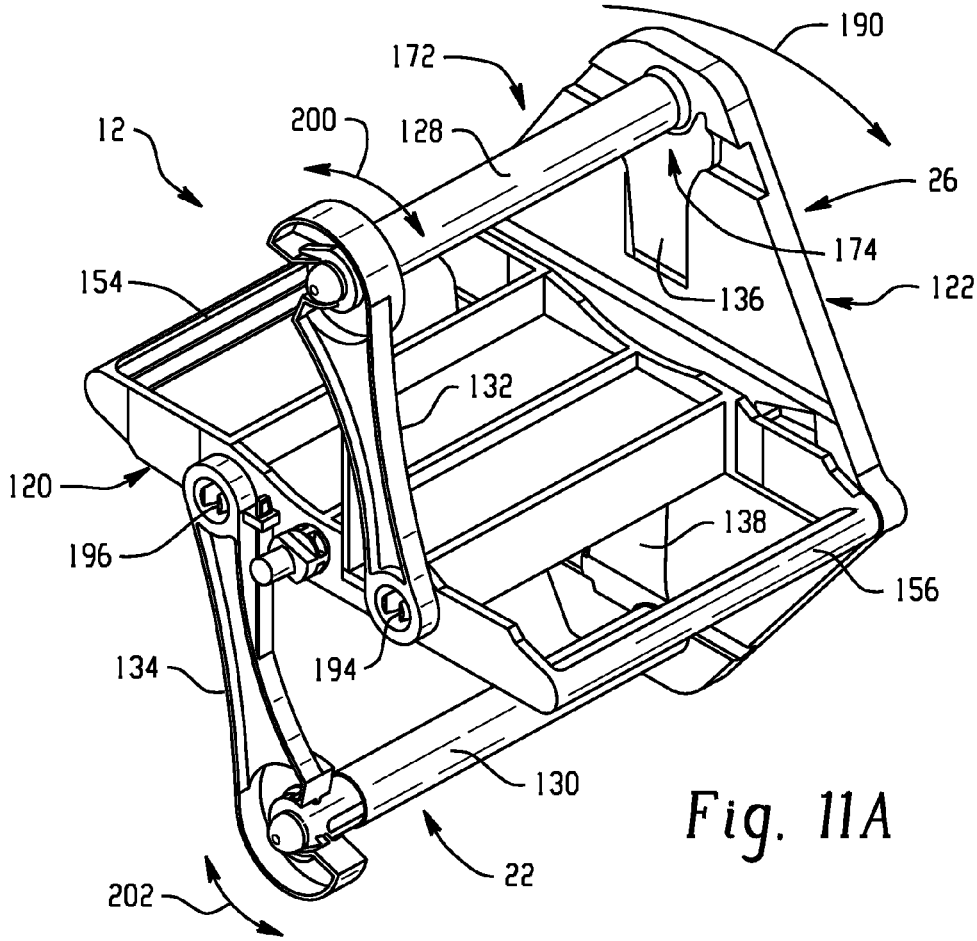
FIG. 11A is a view in perspective of a mounting carousel for the dispenser of FIG. 1, having two mounting spindles for rolls of tissue.
Figure 11B:
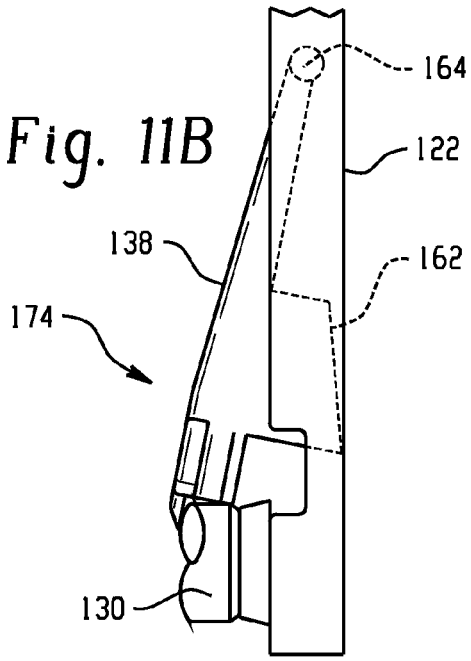
FIG. 11B is a detail of the carousel illustrating the release position of a release arm of the carousel.
Figure 11C:
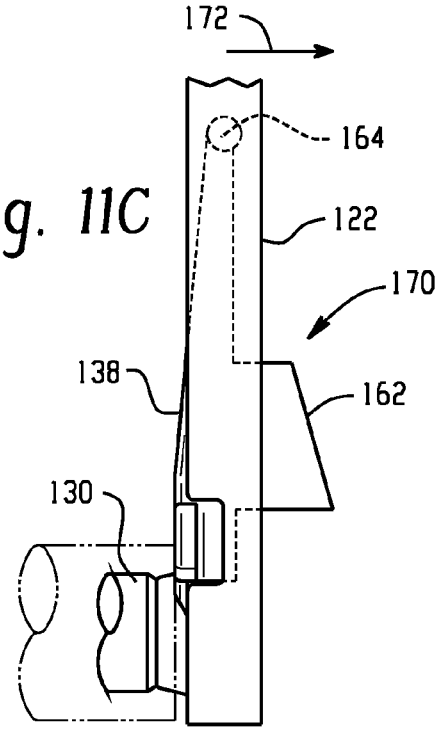
FIG. 11C is another detail of the carousel illustrating a locking position of a release arm.

FIG. 11A is a perspective view of assembled carousel 12, wherein the carousel 12 is empty and release arms 136, 138 are shown in a release position 174. FIG. 11B is a frontal view, showing that the release arms do not project away from mandrel base 122 when in their release positions 174. FIG. 11C, on the other hand, is a frontal view of a portion of a loaded carousel, wherein release arm 136 is pushed outwardly to a locking position 170.

In one embodiment, rolls 24, 28 are suitably coreless tissue rolls which urge the release arms outwardly, i.e., in direction 172 until depleted to the point where they no longer bear upon the arcuate sensor portions of the release arms which then move inwardly to the release position 174 shown in FIGS. 11A, 11C.

Figure 12:
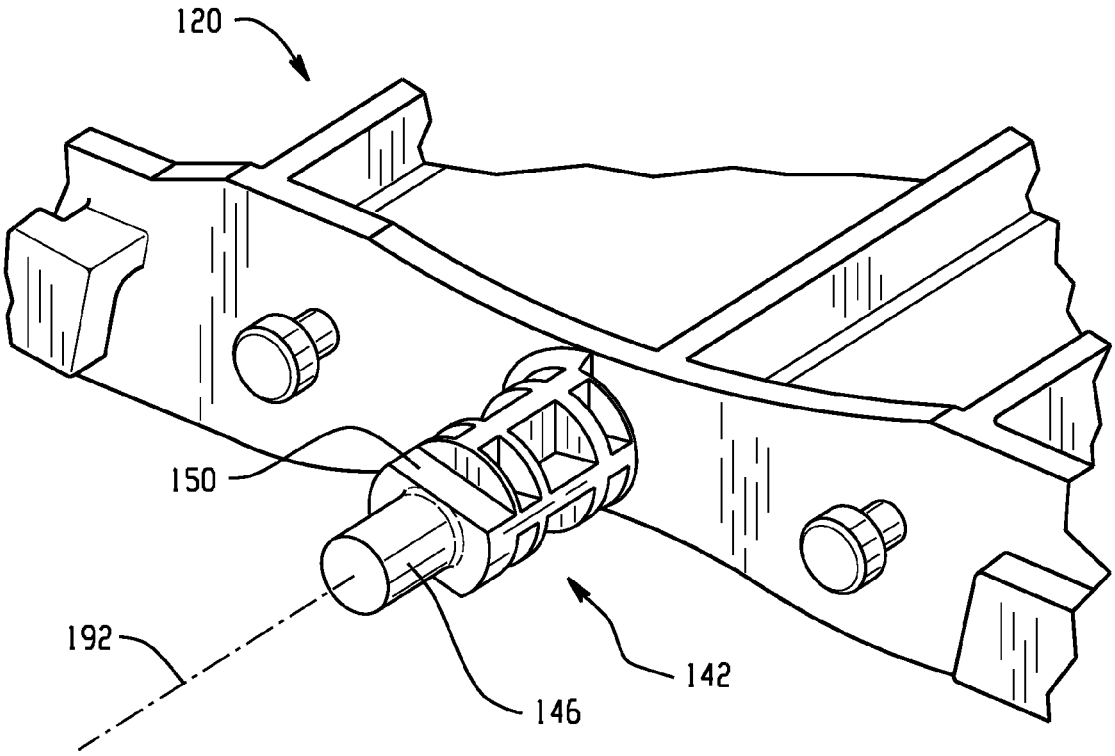
FIG. 12 is an enlarged view showing a mounting shaft portion and locking lug of the carousel frame.

FIG. 12 is an enlarged view of shaft 142 with lug 150 and cylindrical mounting portion 146, which are like corresponding portions of shaft 142. The mounting features provide for mounting carousel 12 in brackets 30, 32 in an inner, locked position 34 (FIG. 13B) where the carousel is locked in position and an outer, freely rotatable reloading position 36 (FIG. 13C). To this end, the mounting brackets have slot with the configuration shown in FIG. 13A.

Figure 13A:
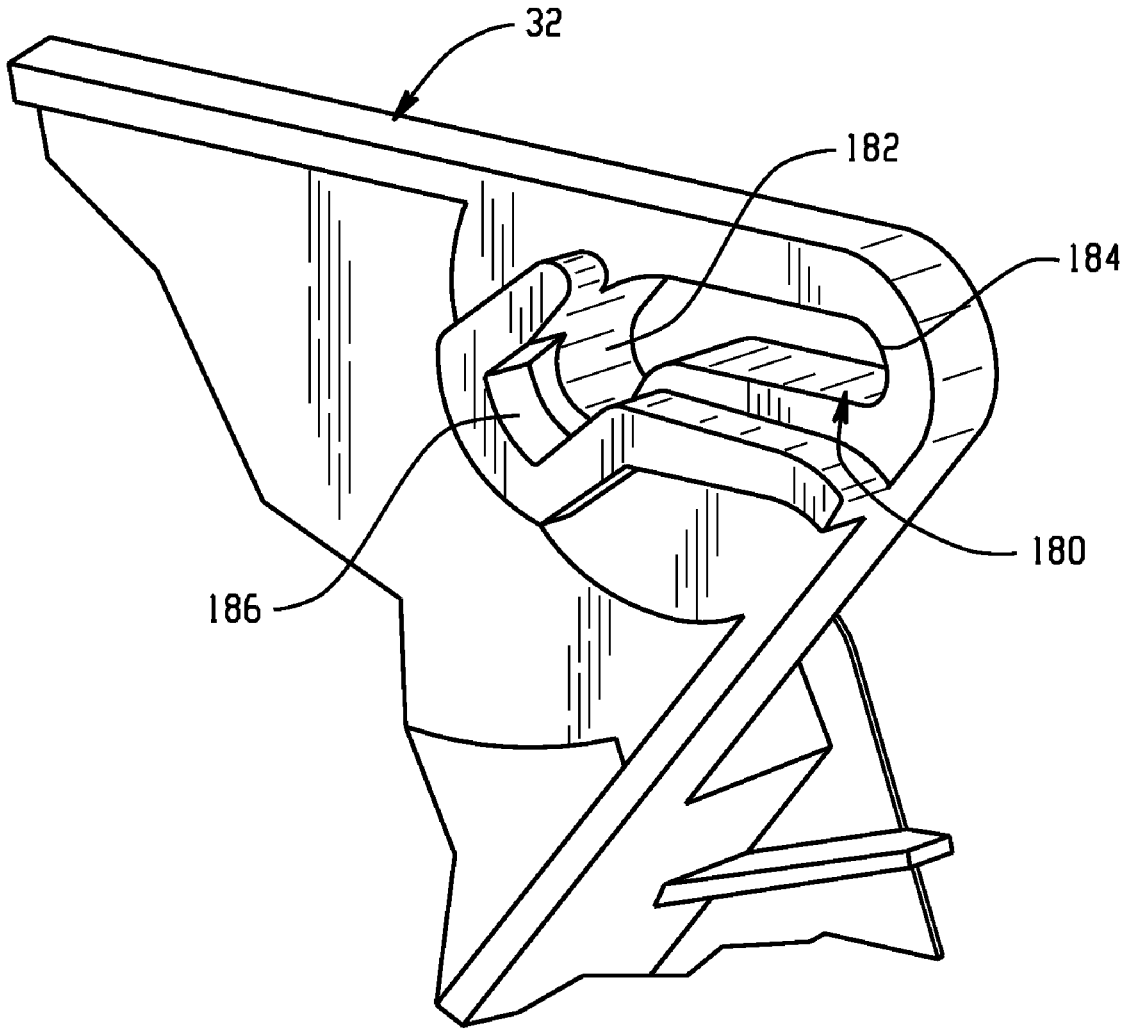
FIG. 13A is a detail of a mounting bracket of the housing.
Figure 13B:
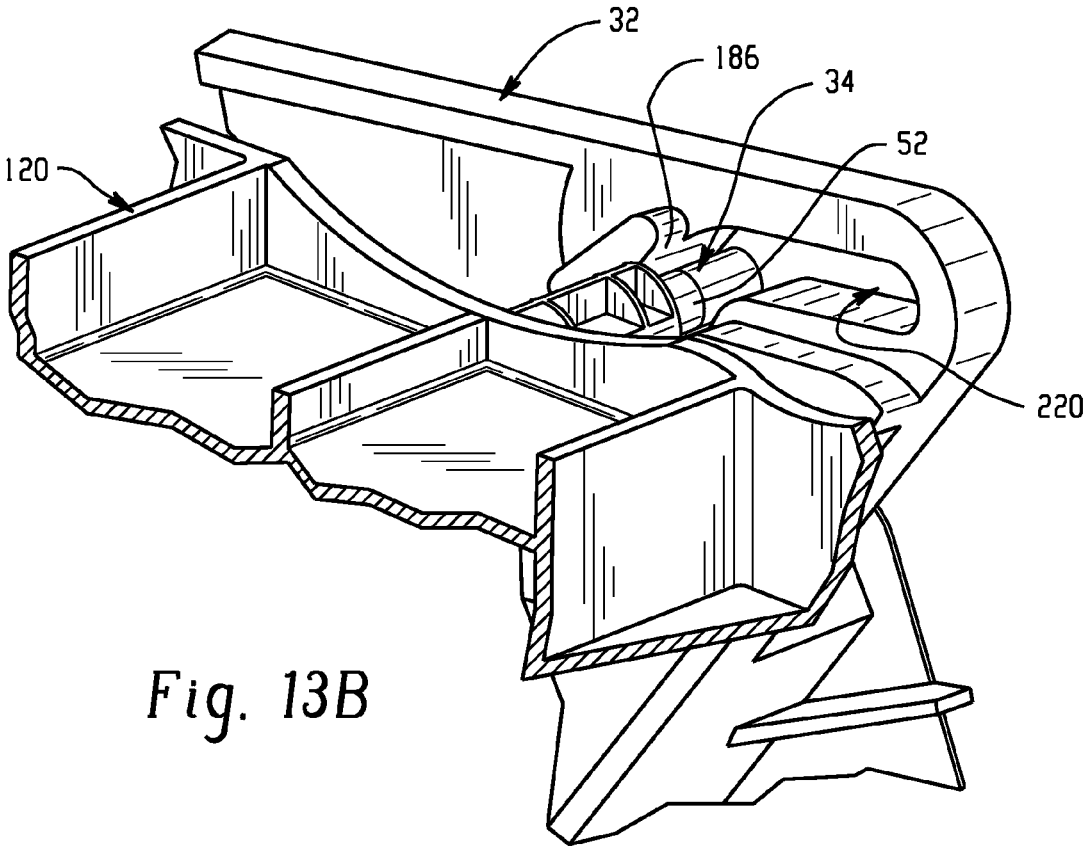
FIG. 13B is a detail showing the carousel rearwardly disposed in a mounting bracket in a locked position for dispensing.
Figure 13C:
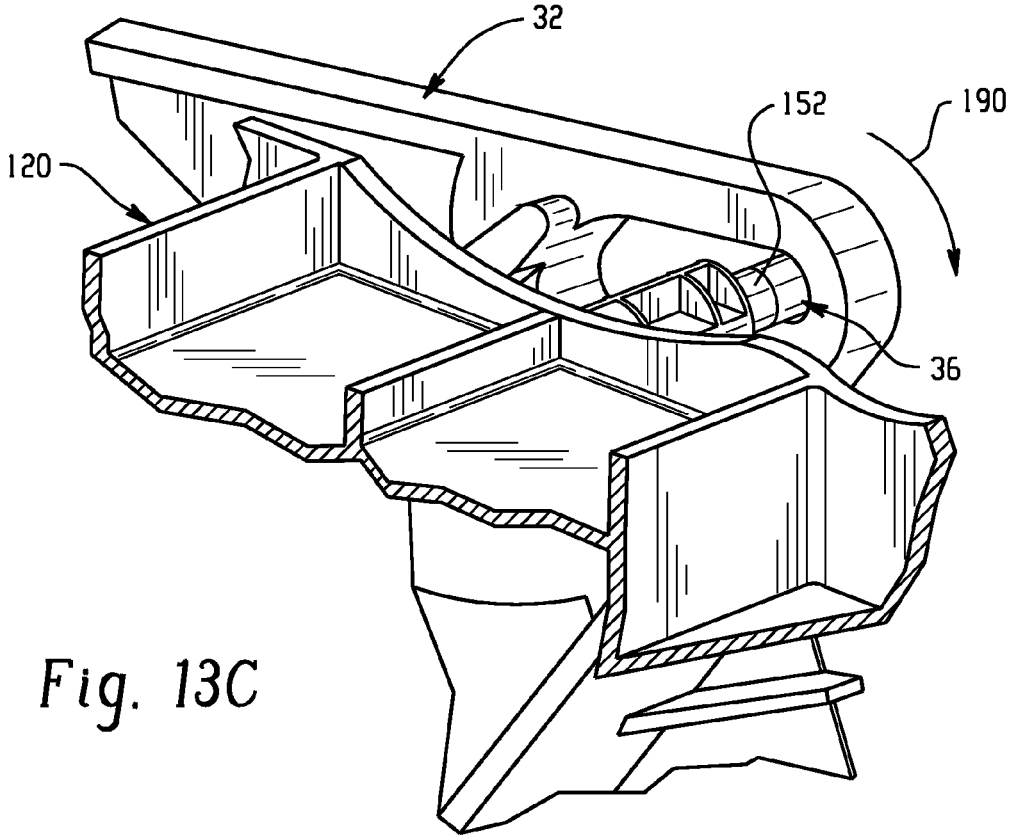
FIG. 13C is a detail showing the carousel forwardly disposed in a rotatable position for reloading.

FIG. 13A is an enlarged perspective view of bracket 30 of dispenser 10. Brackets 30, 32 have mounting slots such as elongate slot 180 with a rearward, downwardly angled portion 182 and a front portion 184. Adjacent portion 182 is a locking channel 186 which cooperates with locking lug 152 of frame 120 to prevent rotation thereof when the frame is in a dispensing position rearward at 34. Lug 152 is axially offset with respect to slot 180, that is offset generally along axis 192 of frame 120. The frame 120 and brackets are configured such that the frame is readily slid forward such that the mounting shaft portion is at 36 wherein the carousel is freely rotatable in a direction 190 for reloading. That is, the mounting portions 146, 148 of frame 120 define an axis of rotation 192 which moves inwardly to a dispensing, locked position at 34 and outwardly to a freely rotatable dispensing position at 36. In this way, the depth of the housing is substantially less than conventional dispensers because the sidewall horizontal span need not accommodate a rotatable position when the carousel is in a dispensing position. Additional clearance from the back of the dispenser is realized when the carousel is moved forwardly.

To facilitate reloading, spindle locks 132, 134 are mounted for rotation at 194, 196 in directions 200, 202 for releasably securing on the spindle rolls of sheet product. Locking slots 204, 206 engage the spindle supporting shafts and securing tissue rolls in place on the spindles.

In one embodiment, the housing (and various other parts as discussed further herein) preferably include unitary, single piece injection-molded parts with molded-in features. Referring again to FIGS. 1 and 2, it is seen that housing 70 includes a unitary back having member 210 which defines brackets 30, 32, dispensing aperture 82 and auxiliary access aperture 84. Housing member 210 has upper sidewall cavities 212, 214, medial sidewall portions 216, 218 which project forwardly about 50% of the distance between back 74 and front 72 as well as lower sidewall portions 220, 222 which project forwardly more than 50% of the horizontal distance between back 74 and front 72. Sidewall portions 220, 222 have mounting slot, such as slot 224, for supporting drive/transfer system 40 including sub-assembly 62.

In one embodiment, auxiliary access door 86 is hinged to member 210 by way of mounting projections such as cylindrical projection 228 (FIG. 2) and is optionally biased to a closed position by way of optional torsion springs such as spring 230. Door 86 can also include raised portion 232 which extends over a limited distance to facilitate manual operation of auxiliary access door 86.

Door 86 is located at a top portion 234 (FIG. 1) of housing 70. Door 86 is likewise a single piece, unitary injection part with mounting projections which mount in housing 70 so that it has an axis of rotation 240 proximate a hinged edge 244 of door 86. A rotatable edge 246 of access door 86 includes a raised portion 232 to facilitate manual opening thereof. The access door and auxiliary aperture 84 suitably have a width 248 corresponding substantially to the roll width 250. Raised portion 232, on the other hand, is intended to be relatively inconspicuous and is typically not longer than, and preferably shorter in length, than distance 248. Preferably, raised portion 232 has a width 249, which is less than 25% of length 248. In alternative embodiments, the auxiliary access aperture and door may be located at a frontal or sidewall portion of the dispenser; most preferably at an upper portion thereof.

The dispenser is thus adapted to be manually operable to expose reserve roll 28 and dispense the tissue through auxiliary access aperture 84 in the event of failure of the automated system for providing tissue for any reason. The automated drive/transfer system is thus designed for added reliability and fits compactly in slots in the housing such as slot 224.

In one embodiment, housing 70 also includes a transparent or translucent cover 260 hinged to member 210 by way of a hinge at 262. Cover 260 is likewise a unitary, single piece injection-molded structure with a pair of upper sidewall lobes 264, 266 which extend to the back of housing 70 such that unobstructed access is obtained to the upper portion of the carousel when housing 70 is in an open position.

Figure 3:
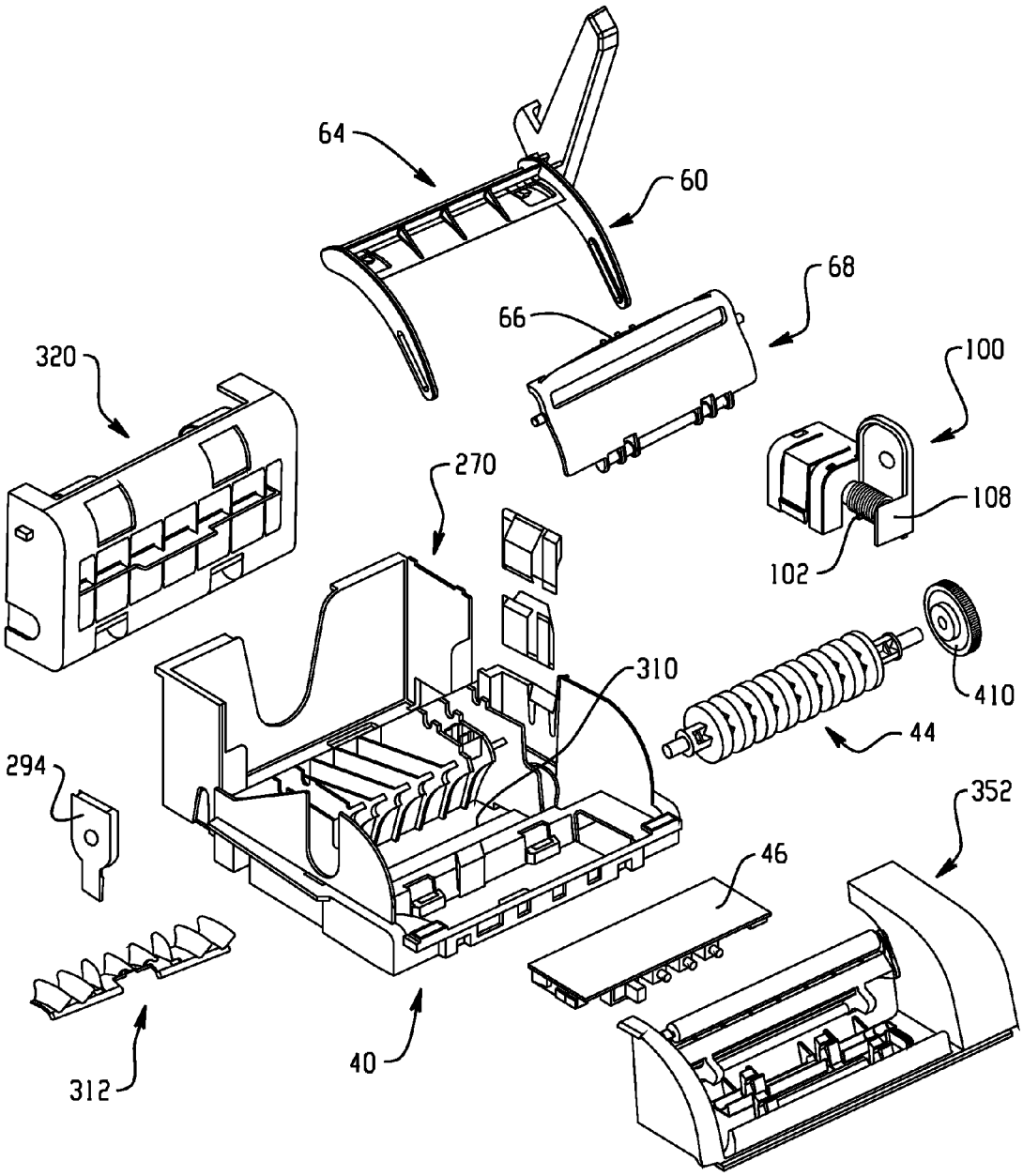
FIG. 3 is an exploded view of drive and transfer modules of the drive/transfer system module of the dispenser of FIGS. 1 and 2.
Figure 14:
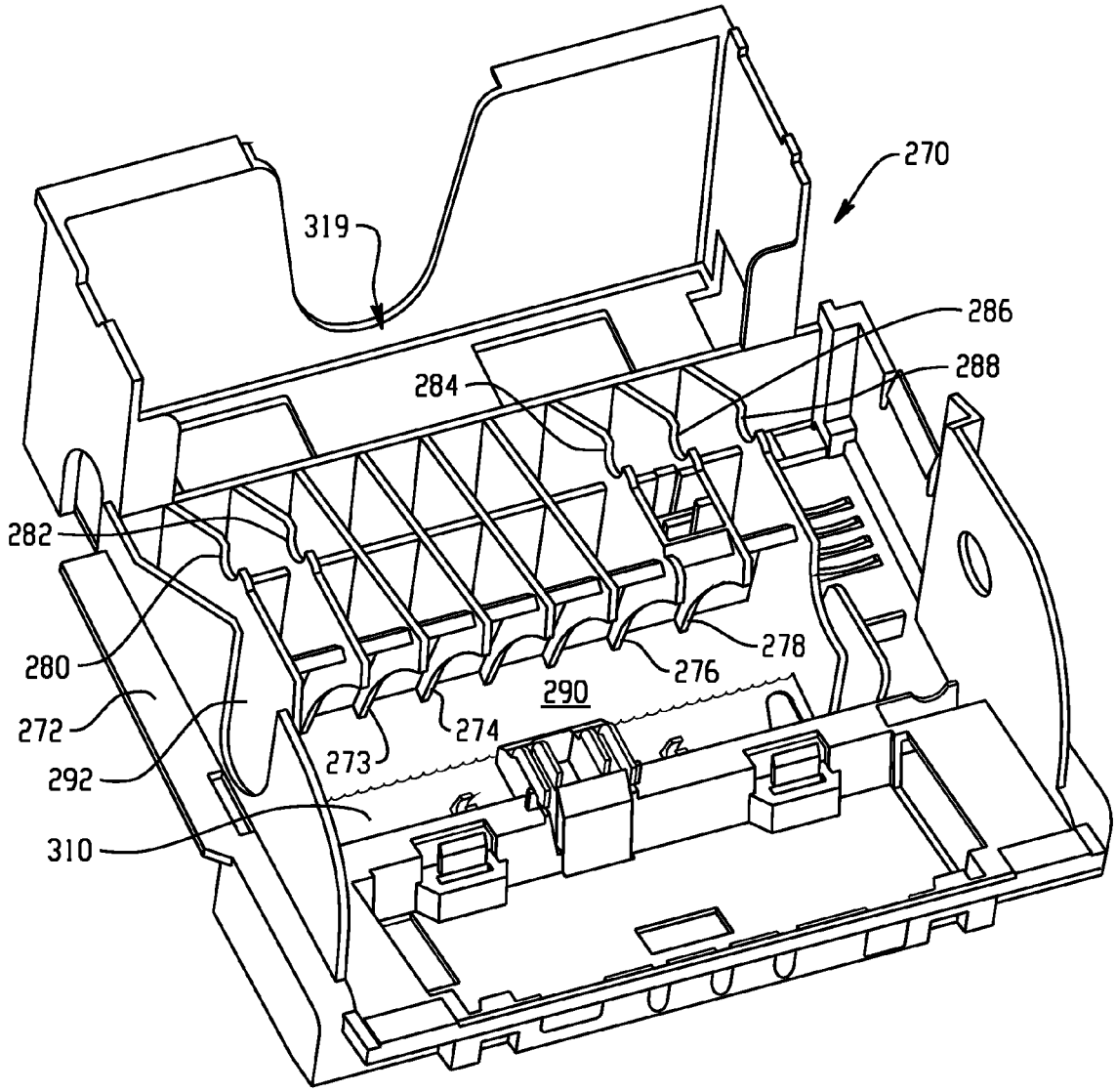
FIG. 14 is a view in perspective of a unitary drive chassis for the dispenser of FIG. 1.

The modular construction of drive system 40 and transfer system 60 are further illustrated in FIGS. 14-19. FIG. 14 is a view in perspective of a drive chassis 270 which has mounting tracks such as track 272 which fits in slots such as slot 224 of housing member 210. Chassis 270 also has a plurality of arcuate guide ridges 273, 274, 276, 278 and so forth and mounting slots 280, 282, 284, 286 and 288. An open area 290 is disposed above dispensing aperture 82 and a molded-in support 292 supports a bearing insert 294 (FIG. 3). The chassis supports drive roller 44, optional tear circuitry 46, sub-assembly 62 as well as transfer frame 64, and an optional serrated transfer bar 310. Chassis 270 also supports an optional reset bar 312, which is provided with a plurality of guide ridges 314, 316, 318. Also provided is a cavity for supporting a battery pack 320 holding batteries 321.

Figure 15:
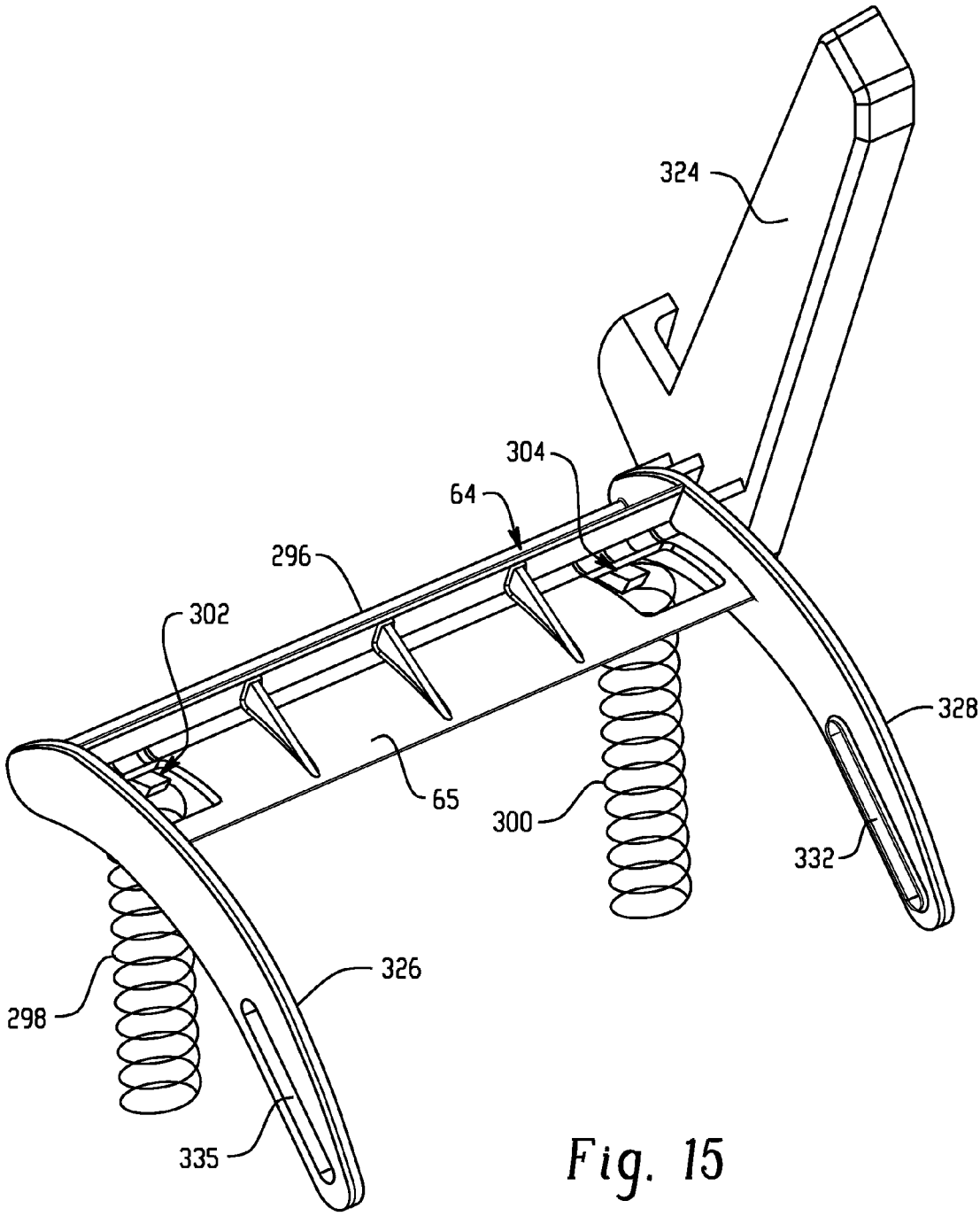
FIG. 15 is a perspective view of the transfer arm.

Referring to FIG. 15, transfer frame 64 is provided with a mounting shaft 296, which is fitted into slots 280, 282, 284, 286 and 288 such that it is pivotally mounted therein. That is, the axis of rotation of frame 64 is along shaft 296, through its center. In one embodiment, optional extension springs 298, 300 are attached to transfer frame 64 at 302, 304 and are secured to chassis 270 such that the transfer frame is biased downwardly, in the direction shown by arrow 322 in FIG. 21 (see also FIG. 22). Frame 64 has a rearward transverse member 65 an elongated locking shaft 324 as well as a pair of forwardly projecting coupling arms 326, 328, provided with slots 330, 332.

Figure 16:
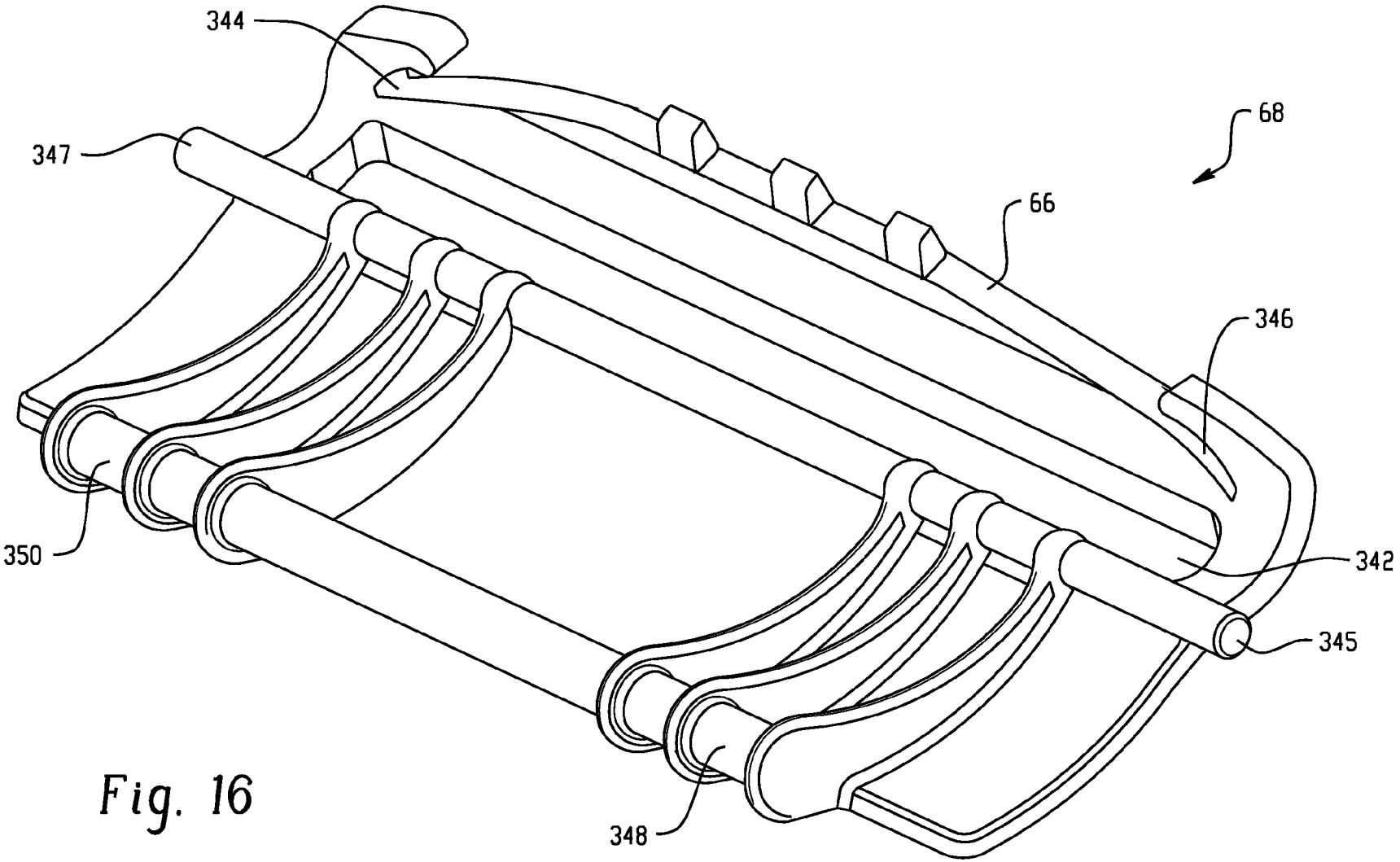
FIG. 16 is a perspective view of the transfer shield.
Figure 16A:
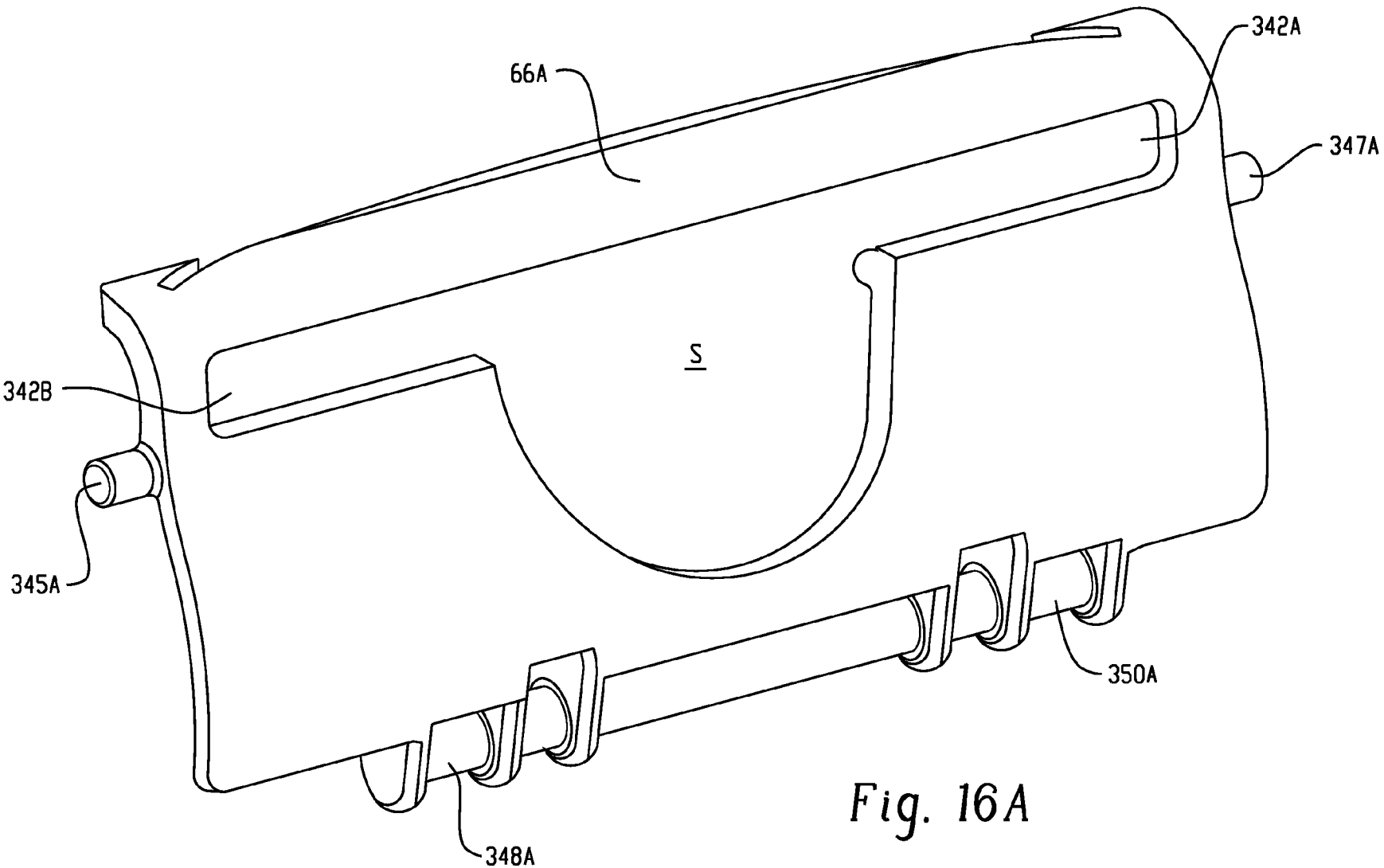
FIG. 16A is a perspective view of an alternate construction of the transfer shield.

There is shown in FIG. 16 in more detail transfer shield 68 which includes at its upper portion transfer bar 66 as well as an elongate guide slot 342 for threading a tail of reserve roll 28. Also provided is a pair of guide notches 344, 346 for guiding the tail into slot 342 when loading dispenser 10. Mounting shaft portions 348, 350 are provided to pivotally secure shield 68 to sub-assembly base 352 of sub-assembly 62, such that its axis of rotation is through the center of shaft portions 348, 350 generally parallel to bar 66 when mounted in base 352. Also provided are coupling bosses 345, 347 in order to couple shield 68 to the transfer frame 64 as is further described below. In one embodiment, shield 68 is a unitary, injection-molded single part. Slot 342 of shield 68 is optionally provided with an enlarged, centrally located portion, designated "S", to facilitate threading of the tail of the reserve roll therethrough as is shown in FIG. 16A where like portions of the transfer shield are labeled with like tag numbers to FIG. 16 having an "A" designation.

Figure 17:
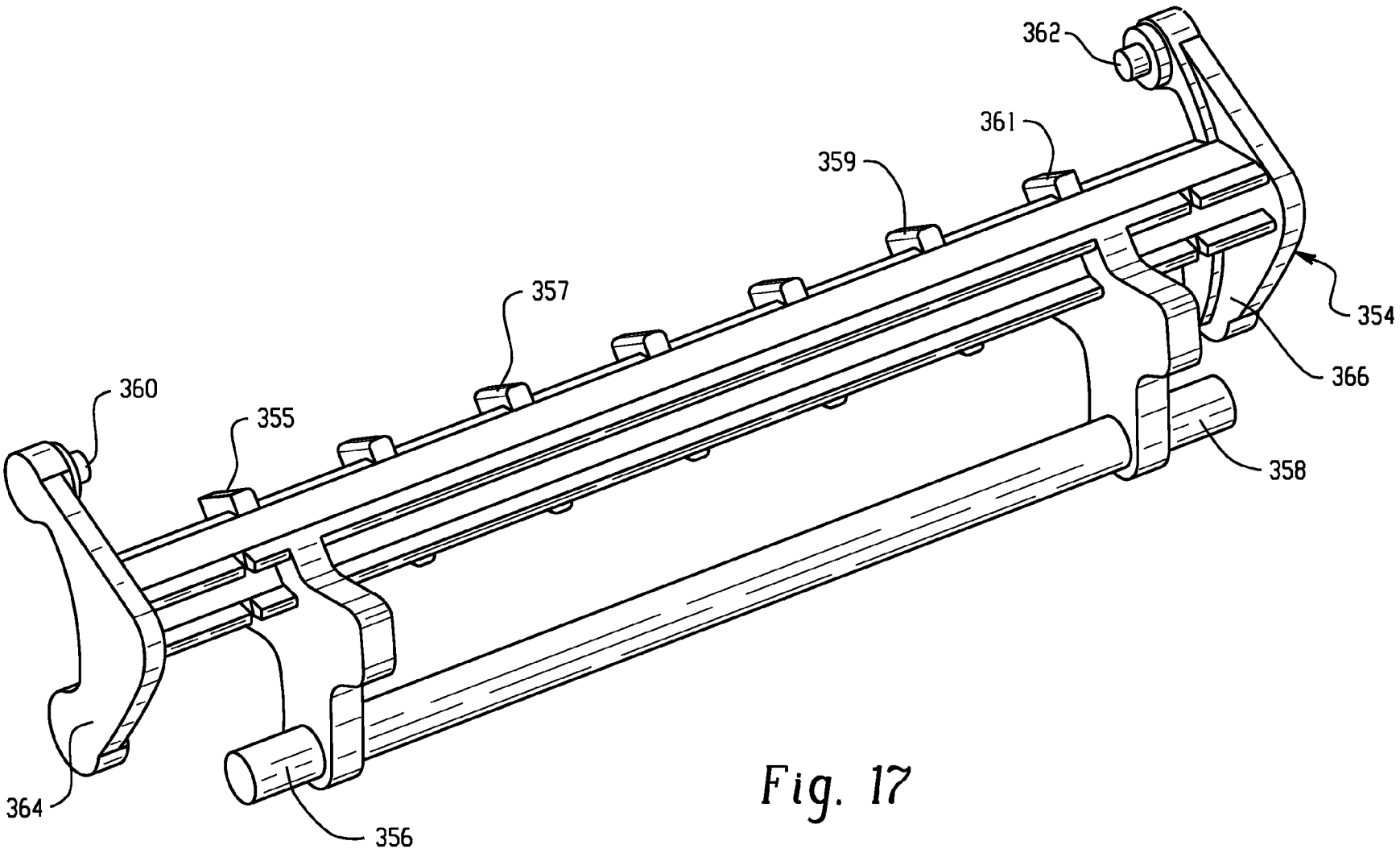
FIG. 17 is a perspective view of the pinch roller frame.

A pinch roller frame 354 is shown in FIGS. 4 and 17. Frame 354 includes mounting shaft portions 356, 358 as well as pinch roller mounts 360, 362, 364 and 366 upon which rollers 48, 50 are mounted. Frame 354 also has guide ridges 355, 357, 359, 361 and so forth, which are configured for guiding the tissue web such that it remains in proximity with the dispensing nips for proper operation of the dispenser.

Figure 5:
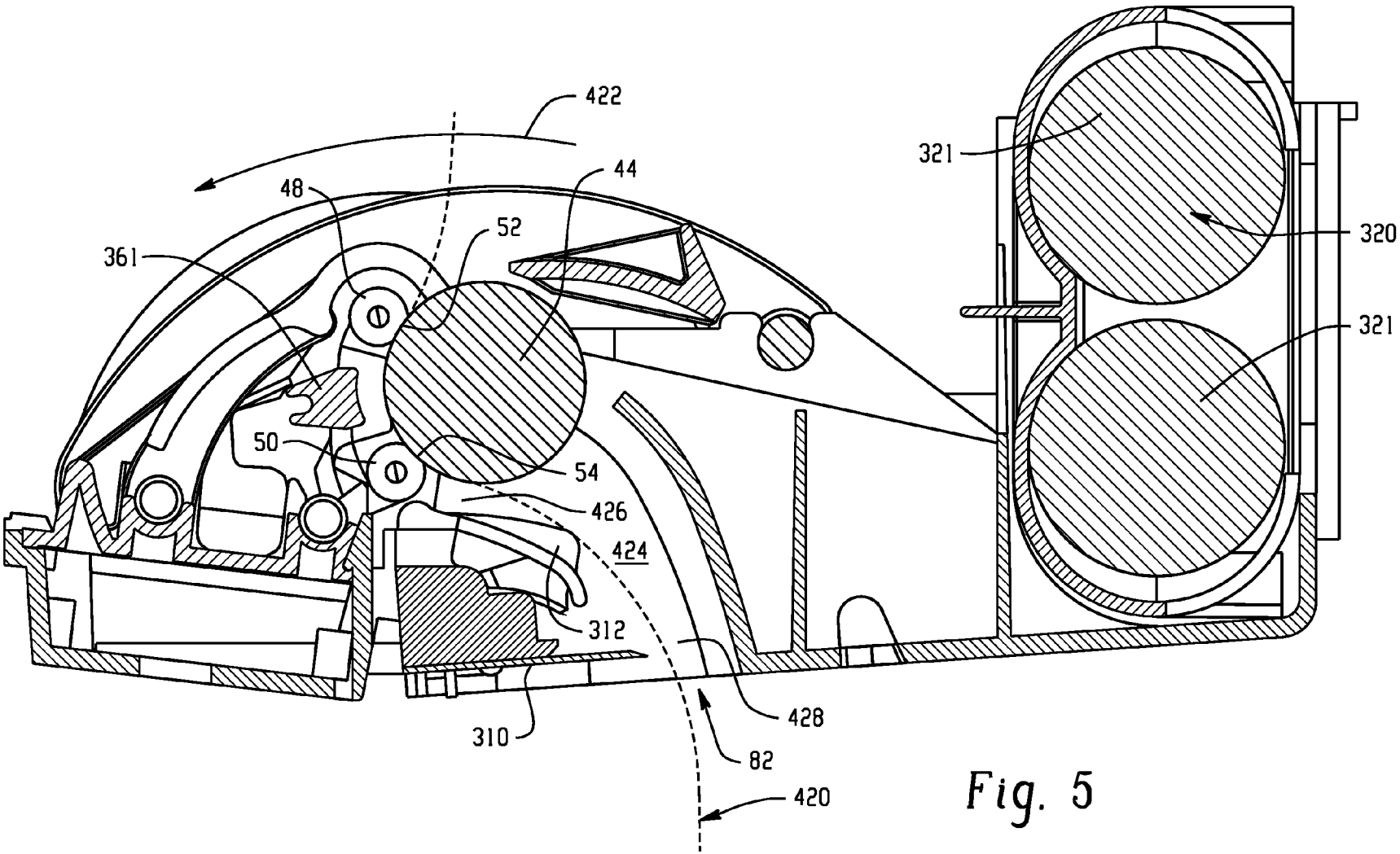
FIG. 5 is a schematic view of the drive system feeding material from a roll over the reset bar through a dispensing aperture of the dispenser.
Figure 18:
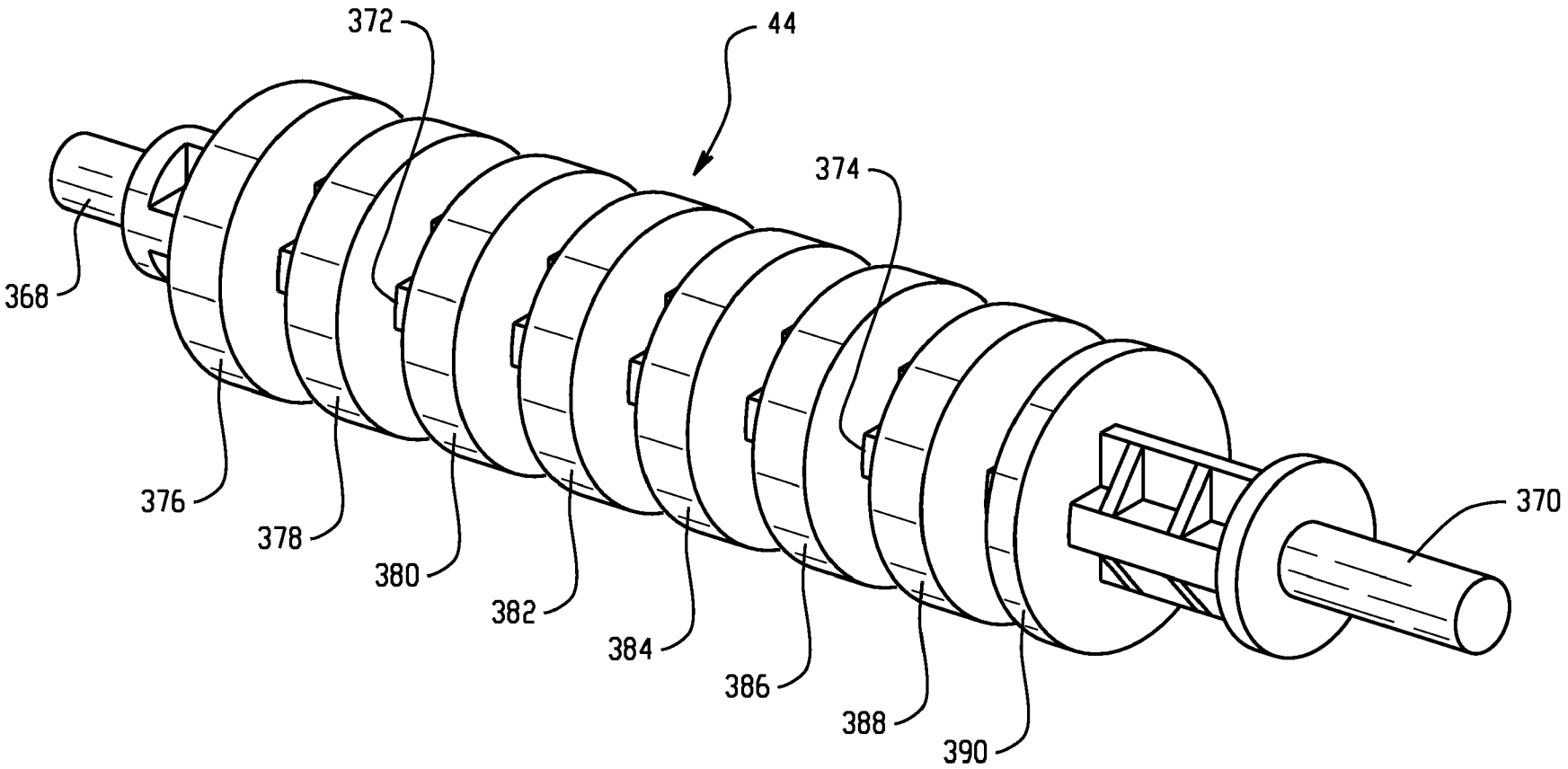
FIG. 18 is a perspective view of the drive roller.

Drive roller 44 is shown in an enlarged perspective view in FIG. 18 and also appears in FIGS. 3 and 5. Roller 44 includes a pair of cylindrical mounting shaft ends 368, 370, medial supporting sections 372, 374 and so forth as well as drive roller segments 376, 378, 380, 382, 384, 386, 388 and 390. In one embodiment, the drive roller circumference profile is that of the drive roller segments, all of which are of the same size and is shown schematically in FIG. 6. In one embodiment, the medial supporting sections of roller 44 are injection-molded from a relatively rigid material, while roller segments 376-390 are injection-molded from an elastomer such as a thermoplastic elastomer as is known in the art. In one embodiment, roller 44 is likewise a unitary, injection-molded part wherein the medial and end portions are over-molded with the drive roller segments.

Figure 19:
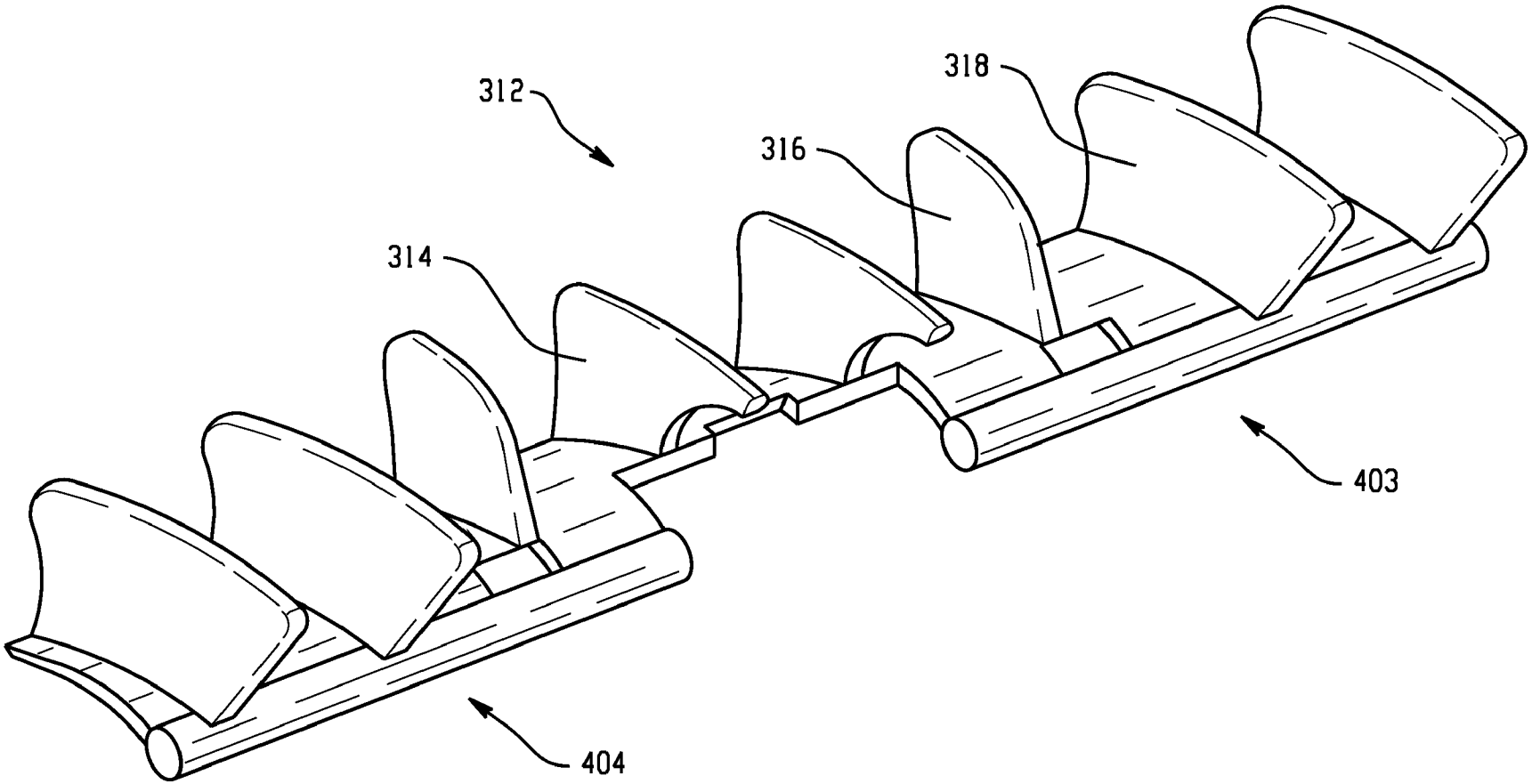
FIG. 19 is a perspective view of the reset bar.

FIG. 19 is an enlarged view of optional reset bar 312, which includes a plurality of guide ridges such as ridges 314, 316 and 318 as well as two mounting shaft portions 403, 404.

In one embodiment, the various parts are assembled as shown in FIGS. 2, 3, 4, 5 7 and 8, through the use of snap-fit and other molded-in features. The various slots, bosses and shafts are illustrated in the Figures and described above. More specifically, carousel 12 is rotatably mounted in brackets 30, 32 by way of mounting portions 146, 148 of support shafts 142, 144 of carousel frame 120.

Other parts are mounted to drive chassis 270 and transfer base 352. For example, in one embodiment, a worm gear member 102 engages spur gear 410 and cavity 104 engages mounting boss 108. Pinch rollers are fitted to pinch roller frame 354, which is mounted to base 352 and biased rearwardly by way of torsion springs 412, 414 (FIG. 4) such that pinch rollers 44, 48 bear upon drive roller 44 to define drive nips 52, 54 (FIGS. 5, 6). Transfer shield 68 is also mounted to base 352, which is pivotally mounted to chassis 270, but is unbiased other than being slidingly coupled to transfer arm 64 by way of coupling bosses 345, 347 being seated in slots 330, 332 of coupling arms 326, 328, respectively.

In one embodiment, bearing insert 294 is mounted to chassis 270 and drive roller 44 is fitted with a spur gear 410 and then disposed in the chassis. Optional reset bar 312 is also fitted to chassis 270 as is optional tear bar 310, circuitry indicated at 46, motor 42 and associated motor mount 100, worm gear member 102 and so forth.

Arm 64 is pivotally mounted in slots 280-288 of chassis 270 and biased downwardly by way of springs 298, 300, which are secured to chassis 270.

Figure 21:
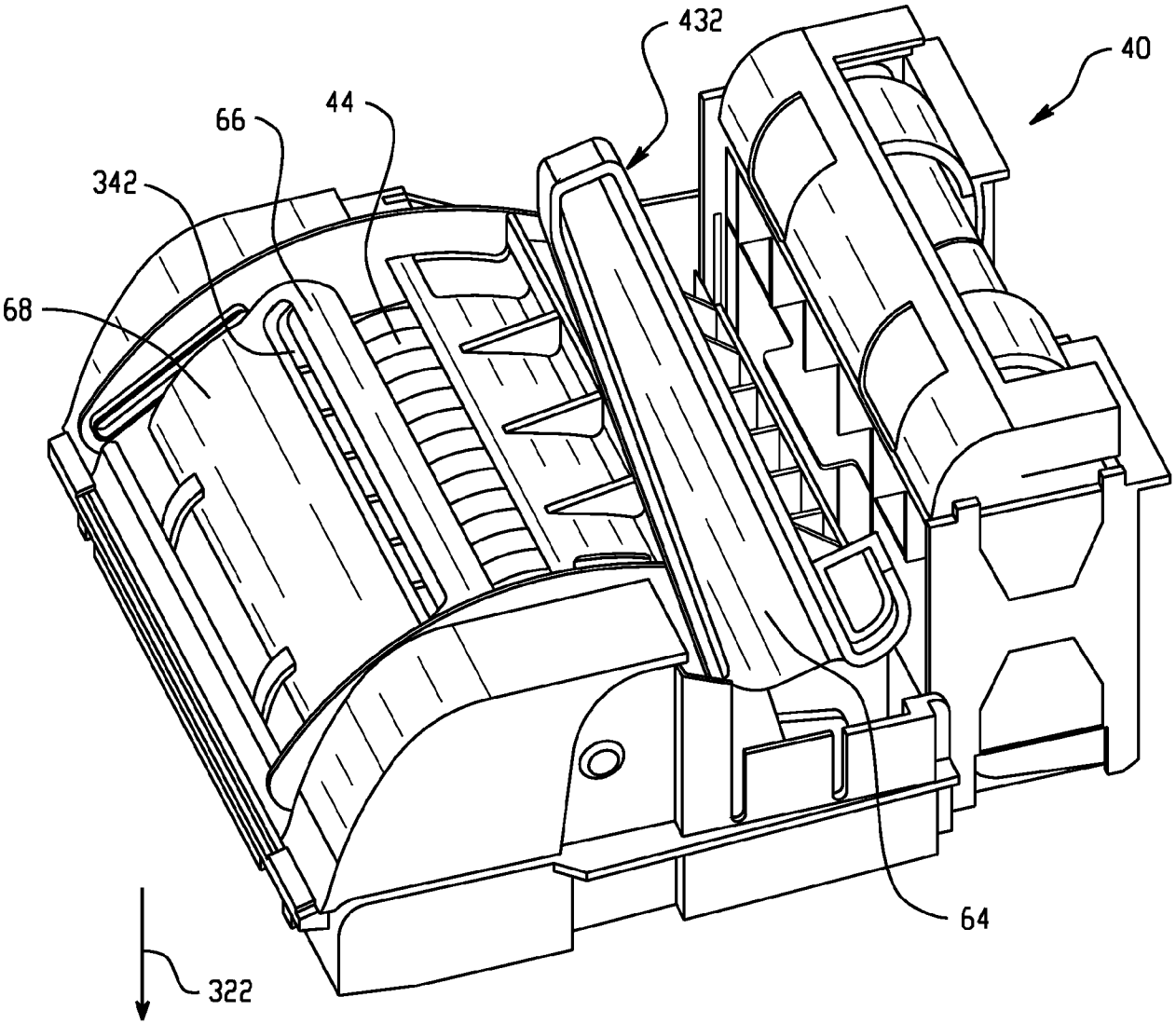
FIG. 21 is a diagram of the drive system and transfer mechanism in a reserve dispensing position.
Figure 22:
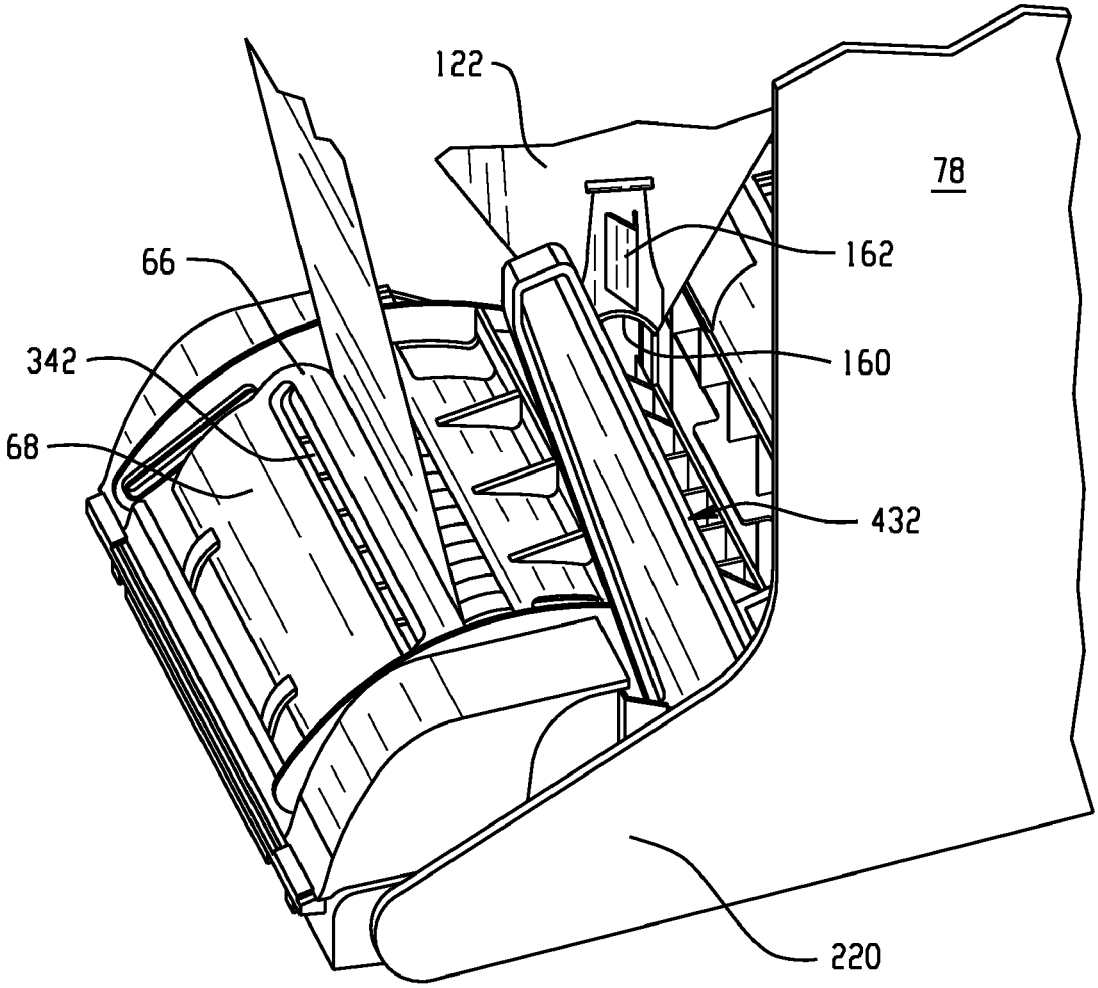
FIG. 22 is an illustration of the dispenser in a reserve dispensing position.

Various portions of drive system 40 are shown in FIGS. 5, 21 and 22 along with a tail 420 (FIG. 5) of a tissue roll being dispensed through aperture 82 of dispenser 10.

In one embodiment, control circuitry at 46 has a proximity sensor responsive to the proximity of a user's hand, for example, and generates a control signal to activate drive motor 42 which, in turn, drives worm gear member 102 which engages spur gear 410 and drives roller 44 in direction 422.

The drive roller thus draws sheet product from a roll through dispensing nips 52, 54 and supplies the sheet product to a dispensing channel 424. Channel 424 has a first downwardly extending portion 426 extending over guide ridges 314, 316, 318 and so forth of reset bar 312. Channel 424 is further provided with an outlet portion 428, which extends substantially vertically to downwardly directed aperture 82. Reset bar is pivotally mounted and biased upwardly by a spring-loaded reset switch (not shown) such that reset bar moves downwardly in direction 430 when a consumer pulls on tail 420 of the tissue roll. As reset bar 312 pivots downwardly, tail 420 will contact tear bar 310 and the web will be severed. The motion of the reset bar triggers the reset switch and control circuitry 46 is reset for another dispensing cycle.

Figure 20:
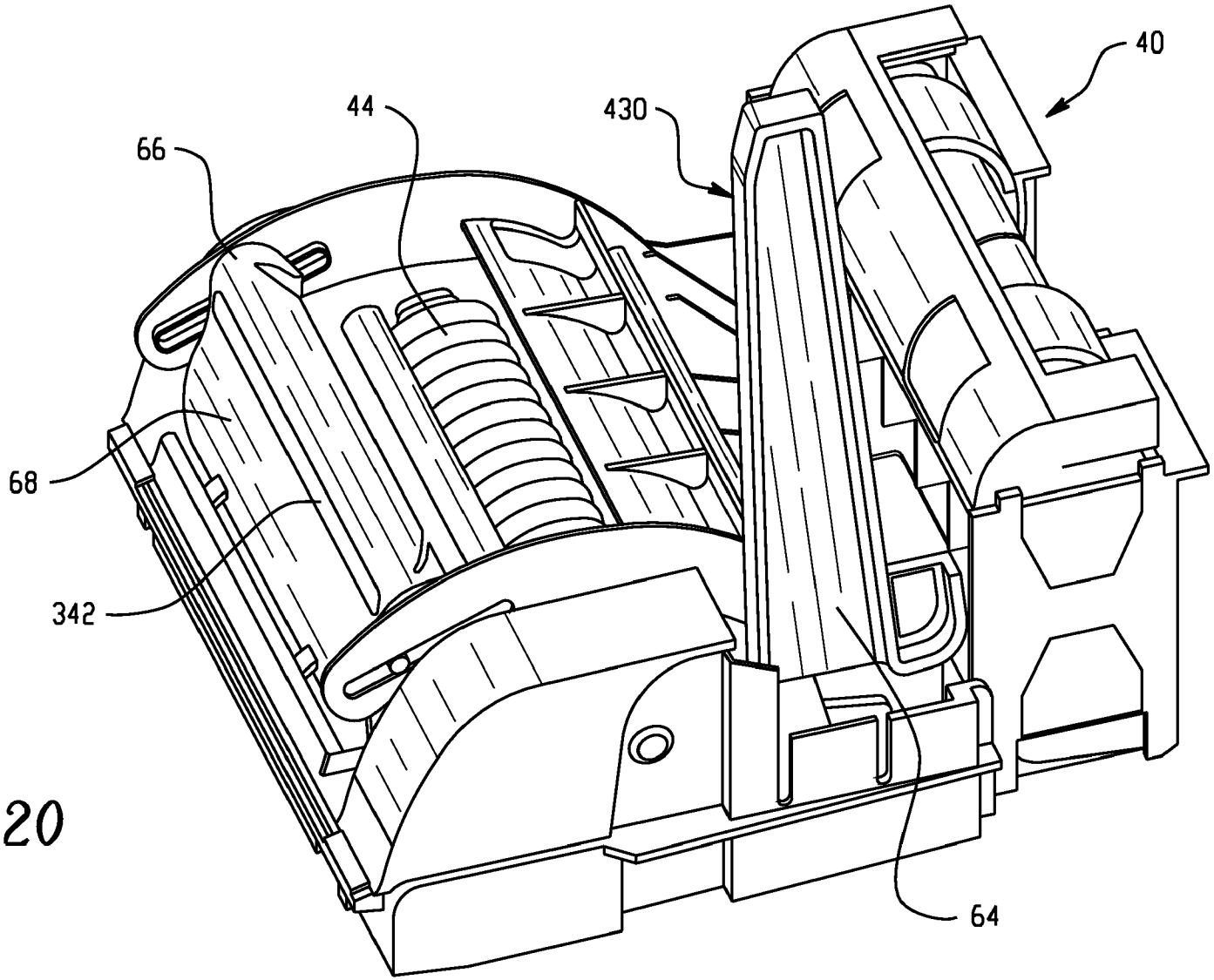
FIG. 20 is a diagram of the drive system and transfer mechanism in a primary dispensing position.
Figure 23:
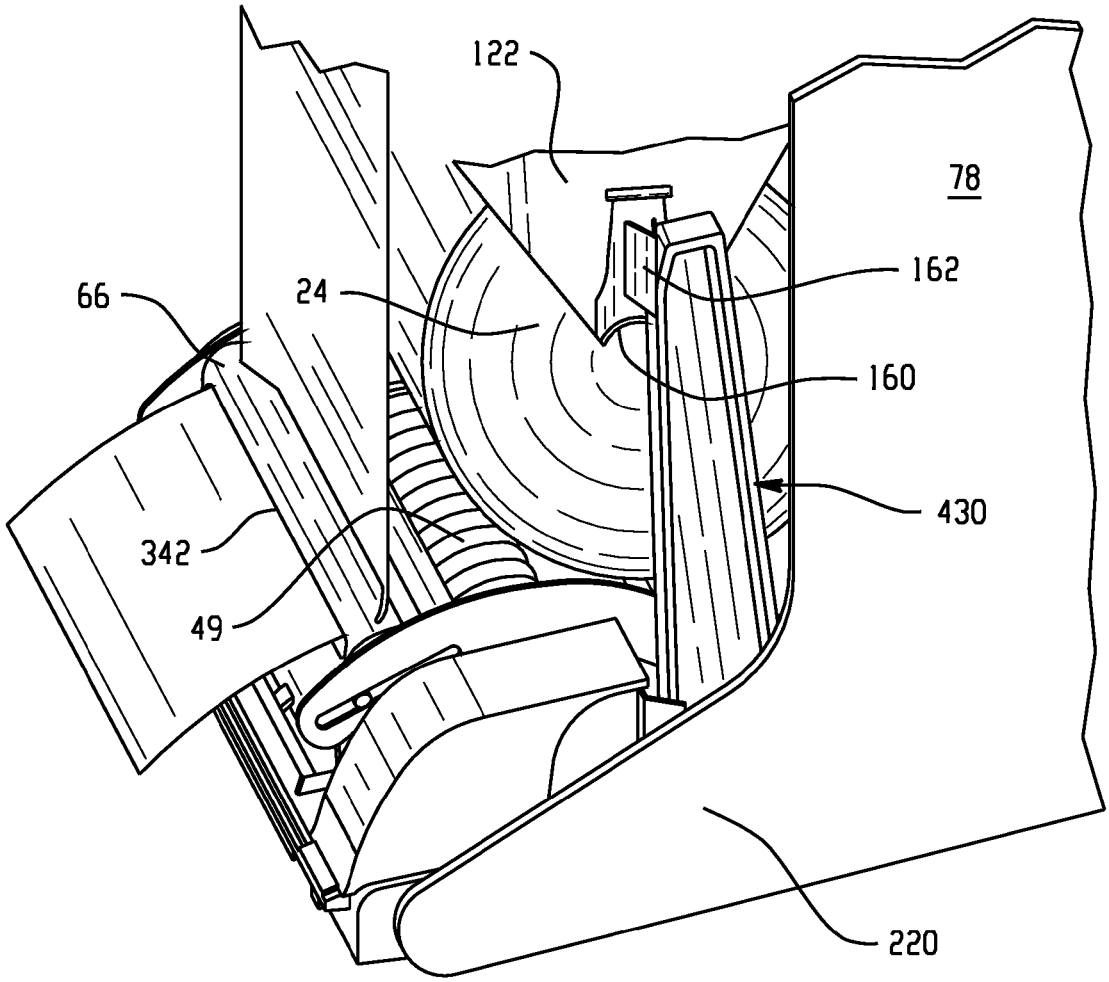
FIG. 23 is an illustration of the dispenser in a primary dispensing position.

FIG. 20 (see also FIG. 23) is a perspective view of chassis 270 and transfer unit 60, wherein transfer bar 66 is in a primary position 430, while in FIG. 21, transfer bar 66 is in a reserve position 432 where bar 66 is rotated so as to be proximate nip 52 and urge a tail of the reserve roll to the dispensing nip.

When the dispenser is loaded, the tail of primary roll 24 is fed to nips 54, 56 from the lower spindle of carousel 12, at mounting station 22. The tail of reserve roll 28 is threaded through guide notches 344, 346 and slot 342 of shield 68. The rolls loaded onto carousel force the release arms outward such that elongated locking shaft 324 and arm 64 are locked in primary position 430 since the release arms are in position 170 and the carousel is mounted such that the locking projections, such as projections 62, engages shaft 324, holding transfer arm 64 in position 430.

In position 430, slots 330, 332 of coupling arms 326, 328 engage guide bosses 345, 347 of transfer shield 68 and hold the shield distal to dispensing nip 52, such that bar 66 does not feed the tail of reserve roll 28 to the drive roll. Guide bars 154, 156 of the carousel also guide the tail of the reserve roll away from drive roll 44.

In one embodiment, upon depletion of the primary roll, its associated release arm moves inwardly to a release position 174 (FIGS. 11A, 11B). Arm 64 is thus released, such that arm 64 is pulled downwardly by optional extension springs 298, 300 to the reserve position 432 shown in FIG. 21. In reserve position 432, slots 330, 332 pull shield 340 toward nip 52, thereby feeding the reserve roll to the drive system.

In one embodiment, control circuitry 46 senses the transition of transfer unit 60 from primary position 430 to reserve position 432 and provides notification to maintenance personnel by powering a light emitting diode, for example.

Manufacture and assembly of dispenser 10 is greatly facilitated through the use of unitary, injection-molded, single piece parts with multiple features as well as the modular design illustrated. For example, the following unitary parts may be molded or extruded from any suitable material with the features shown above: transfer frame 64; auxiliary access door 84; motor mount 100; carousel frame 120; mandrel base 122; support shafts 122, 124; spindles 128, 130; spindle locks 132, 134; release arms 136, 138; housing member 210; cover 260; drive chassis 270; reset bar 312; battery pack 320; transfer shield 340; transfer base 352; and pinch roller frame 354. Suitable materials include polyacetal or polytetrafluoroethylene where a lubricious surface is desired. Most parts can be injection-molded from a material containing a thermoplastic resin. Suitable thermoplastic resins include, but are not limited to, acrylonitrile-butadiene-styrene (ABS) resins, polyacrylic resins; polycarbonate resins; polystyrene resins; and styrene-acrylic copolymer resins.

The modular construction of the dispenser likewise greatly simplifies maintenance; to this end, it will be appreciated from the foregoing description and appended drawings that the modular design/transfer system 40 as well as carousel 12 are readily removable/replaceable without the use of tools. Maintenance of the dispenser is thus greatly simplified and may be performed by maintenance workers without the need for sophisticated equipment or training.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. An automated dispenser comprising:

a first mounting station for a primary roll of sheet product;

a second mounting station including a support spindle for a reserve roll of sheet product;

a drive system including a motor coupled to a drive roll and control circuitry as well as a pinch roller defining a dispensing nip with the drive roll adapted to dispense sheet product through the dispensing nip in response to a control signal controlling the motor; and a housing enclosing the first and second mounting stations in an undivided space partially occupied by the first and second mounting stations thereby sequestering the primary and reserve rolls of sheet product, the housing including a back surface, a primary access aperture, and an auxiliary access aperture fitted with an auxiliary access door, the auxiliary access aperture and access door being disposed proximate the mounting station for the reserve roll, being disposed distant from the mounting station for the primary roll, and being partially disposed between the back surface and a plane substantially parallel to the back surface, the plane intersecting a rotational axis of the reserve roll defined by the support spindle, and being configured and adapted to be manually operable to expose the reserve roll for manual dispensing.

2. The automated dispenser according to claim 1, wherein the access door has a width corresponding substantially to a width of the reserve roll of sheet product.

3. The automated dispenser according to claim 2, wherein the access door has a width less than an overall width of the housing.

4. The automated dispenser according to claim 1, wherein:

the housing further comprises a dispensing aperture disposed proximate the mounting station for the primary roll; and the auxiliary access aperture is separate from the dispensing aperture.

5. The automated dispenser according to claim 1, wherein the auxiliary access aperture and access door are disposed such that there is unobstructed access to the reserve roll and obstructed access to the primary roll when the access door is open.

6. The automated dispenser according to claim 1, wherein the housing further comprises a front portion openably attached to a back portion that provides unobstructed access to both the primary roll and the reserve roll when the front portion is open relative to the back portion.

7. The automated dispenser according to claim 1, wherein the access door comprises an offset portion configured and adapted to facilitate manual opening of the access door.

8. The automated dispenser according to claim 1, further comprising a biasing member disposed between the access door and the housing biasing the access door in a closed position relative to the housing.

9. The dispenser of claim 1, wherein the undivided space is communicative with the primary access aperture and the auxiliary access aperture.

10. An automated dispenser comprising:

a first mounting station for a primary roll of sheet product;

a second mounting station including a support spindle for a reserve roll of sheet product;

a drive system including a motor coupled to a drive roll and control circuitry as well as a pinch roller defining a dispensing nip with the drive roll adapted to dispense sheet product through the dispensing nip in response to a control signal controlling the motor; and a housing comprising a front portion openably attached to a back portion having a back surface, the housing enclosing the first and second mounting stations in an undivided space partially occupied by the first and second mounting stations thereby sequestering the primary and reserve rolls of sheet product, the housing further including a primary access aperture and an auxiliary access aperture fitted with an auxiliary access door, the auxiliary access aperture and access door being configured and adapted to be manually operable to expose the reserve roll for manual dispensing when the front portion is closed relative to the back portion, the auxiliary access aperture and the auxiliary access door arranged partially between the back surface and a plane substantially parallel to the back surface, the plane intersecting a rotational axis of the reserve roll defined by the support spindle.

11. The dispenser of claim 10, wherein the undivided space is communicative with the primary access aperture and the auxiliary access aperture.

* * * * *